US010244299B2

(12) United States Patent
Besgen, Sr.

(10) Patent No.: US 10,244,299 B2
(45) Date of Patent: Mar. 26, 2019

(54) METHODS AND APPARATUS FOR WEARABLE PERSONAL SOUND SPEAKER SYSTEMS

(71) Applicant: Christopher Michael Besgen, Sr., Ridgefield, CT (US)

(72) Inventor: Christopher Michael Besgen, Sr., Ridgefield, CT (US)

( * ) Notice: Subject to any disclaimer, the term of this patent is extended or adjusted under 35 U.S.C. 154(b) by 0 days.

(21) Appl. No.: 15/290,984

(22) Filed: Oct. 11, 2016

(65) Prior Publication Data

US 2017/0034608 A1 Feb. 2, 2017

Related U.S. Application Data

(63) Continuation of application No. 14/446,200, filed on Jul. 29, 2014, now Pat. No. 9,467,768, which is a continuation-in-part of application No. 13/794,782, filed on Mar. 11, 2013, now abandoned.

(60) Provisional application No. 61/609,291, filed on Mar. 10, 2012.

(51) Int. Cl.

| | |
|---|---|
| ***H04R 1/02*** | (2006.01) |
| ***H04R 1/10*** | (2006.01) |
| ***A42B 1/06*** | (2006.01) |
| ***A42B 1/24*** | (2006.01) |

(52) U.S. Cl.

CPC ..... *H04R 1/026* (2013.01); *A42B 1/062* (2013.01); *A42B 1/245* (2013.01); *H04R 1/028* (2013.01); *H04R 1/1066* (2013.01); *H04R 1/1008* (2013.01); *H04R 1/1016* (2013.01); *H04R 2201/023* (2013.01); *H04R 2201/025* (2013.01); *H04R 2201/028* (2013.01); *H04R 2400/11* (2013.01)

(58) Field of Classification Search

CPC .... H04R 5/02; H04R 5/023; H04R 2201/023; H04R 5/0335; H04R 1/1066; H04R 1/028; H04R 1/1008; H04R 1/1016; H04R 1/026; H04R 2201/025; H04R 2201/028; A42B 1/062; A42B 1/245

USPC ..... 381/333, 334, 332, 336, 373

See application file for complete search history.

(56) References Cited

U.S. PATENT DOCUMENTS

| | | | | |
|---|---|---|---|---|
| 4,190,738 A * | 2/1980 | Samuels | H04R 1/02 181/199 |
| 5,438,698 A * | 8/1995 | Burton | H01Q 1/276 2/209.13 |
| 2002/0118825 A1* | 8/2002 | Mitra | H04M 1/05 379/430 |
| 2002/0131616 A1* | 9/2002 | Bronnikov | H04B 1/38 381/370 |
| 2004/0128737 A1* | 7/2004 | Gesten | A42B 1/245 2/171 |
| 2011/0191941 A1* | 8/2011 | Chiang | A42B 1/245 2/209.13 |

* cited by examiner

*Primary Examiner* — Paul Kim
*Assistant Examiner* — Douglas J Suthers

(57) ABSTRACT

Embodiments of the invention provide a wearable personal sound speaker system kit. The kit includes a speaker housing adapted to securely hold a speaker; an attachment mechanism adapted to secure the kit to a worn item; and a connector adapted to couple the speaker housing to the attachment mechanism. The kit is adapted to support the speaker proximate to a user's ear without contacting the ear. Numerous additional features are disclosed.

20 Claims, 23 Drawing Sheets

602

602

METHODS AND APPARATUS FOR WEARABLE PERSONAL SOUND SPEAKER SYSTEMS

CROSS-REFERENCE TO RELATED APPLICATIONS

The present application is a continuation of co-pending, commonly owned, U.S. patent application Ser. No. 14/446,200 filed Jul. 29, 2014, entitled "METHODS AND APPARATUS FOR WEARABLE PERSONAL SOUND SPEAKER SYSTEMS" which is a continuation-in-part of commonly owned, U.S. patent application Ser. No. 13/794,782 filed Mar. 11, 2013, entitled "METHODS AND APPARATUS FOR HEAD-WEARABLE PERSONAL SOUND SPEAKER SYSTEMS" which claims the benefit of US Provisional Patent Application 61/609,291 filed Mar. 10, 2012, entitled "METHODS AND APPARATUS FOR HEAD-WEARABLE PERSONAL SOUND SPEAKER SYSTEMS" the entirety of all of which are hereby incorporated herein by reference for all purposes.

FIELD

The present invention generally relates to personal sound speaker systems, and more particularly is directed to methods and apparatus for wearable personal sound speaker systems.

BACKGROUND

With the proliferation of cell phones and portable music devices, many personal portable sound speaker systems (e.g., headphones, earphones, etc.) have been developed that allow the user to participate in relatively vigorous activities (e.g., sports) while listening to their devices and largely block out other environment noises. In some environments however, personal sound systems that exclude or otherwise prevent a user from clearly hearing surrounding sounds can be undesirable. For example, while riding a bicycle or jogging on a street, there may be safety issues with not being able to hear traffic. In fact, many organized road race events do not permit competitors to wear any kind of device that is inserted into, covers, or contacts the competitor's ears. For example, the Official Rules and Regulations for the "Reach the Beach Relay" held annually in New Hampshire includes Rule No. 11.13 which specifies "the use of any type of earphone in the ear of the runner" is not permitted at any time during the race. Thus, what is needed is a personal sound system that allows users to enjoy music or communicate on a cell phone while not blocking out other environment sounds.

SUMMARY

Inventive methods and apparatus are provided for a visor, cap, or headband including an adjustable strap; a bill attached to the headband and including an flexible fabric sound speaker integrally formed within the bill; an amplifier including a signal input, the amplifier removably attached to the headband and coupled to the speaker; and a power supply removably attached to the headband and coupled to the amplifier.

In some embodiments of the invention, a speaker system is provided. The system includes a speaker; a speaker housing adapted to securely hold the speaker; a frame member; an attachment member operable to allow attachment of the frame to a head worn item; and an adjustable connector that couples the speaker housing to the frame and allows aiming of the speaker. The system is adapted to support the speaker proximate to a user's ear without contacting the ear.

In some embodiments of the invention, a wearable personal sound speaker system kit is provided. The kit includes a speaker housing adapted to securely hold a speaker; an attachment mechanism adapted to secure the kit to a worn item; and a connector adapted to couple the speaker housing to the attachment mechanism. The kit is adapted to support the speaker proximate to a user's ear without contacting the ear.

In other embodiments, a wearable personal sound speaker system is provided. The system includes a wearable item; a pair of speakers; and a kit adapted to support the speakers proximate to a user's ears without contacting the ears. The kit including, for each ear of the user, a speaker housing adapted to securely hold one of the speakers; an attachment mechanism adapted to secure the kit to the wearable item; and a connector adapted to couple the speaker housing to the attachment mechanism.

In yet other embodiments, a method of manufacturing a wearable personal sound speaker system kit is provided. The method includes providing a speaker housing adapted to securely hold a speaker; providing an attachment mechanism adapted to secure the kit to a worn item; and coupling the speaker housing to the attachment mechanism using a connector. The kit is adapted to support the speaker proximate to a user's ear without contacting the ear.

Numerous other aspects are provided. Other features and aspects of the present invention will become more fully apparent from the following detailed description, the appended claims and the accompanying drawings.

DETAILED DESCRIPTION

The present invention provides methods and apparatus for a wearable personal sound speaker system and kits for the same. In some embodiments, a visor or baseball style cap that includes a bill or sun shade that extends from the front of the visor includes one or more integrally formed flexible speaker elements within the bill. In other words, the speaker elements may be used to form the bill or part thereof. The bill and/or the speaker elements are disposed to direct sound that emanates from the speaker elements toward the ears of the user. In some embodiments, the speaker elements may be embodied as low-power (e.g., <0.1 W), thin (e.g., <0.2 inches), light weight (e.g., <0.1 g/cm$^2$) flexible speakers, for example such as those manufactured by Verisonix Corporation of Taipei, Taiwan or the model TLF type speakers manufactured by Yamaha Corporation of Tokyo, Japan. In some embodiments, the speaker elements maybe directional speakers that emit sound in parallel, directed waves such that the sound is limited to the line in which it is aimed. In some embodiments, small conventional speakers may be used.

In alternative embodiments, the system can include arms or wings for mounting speakers or earbud sound systems to eyeglasses, sunglasses, a hat, a headband or other neck or head-worn clothing, item, or device without any part of the system contacting the user's ears or preventing the user from hearing sound from other sources but still allowing sound from the system to reach the user's ears with acceptable fidelity and volume.

Figure 1:
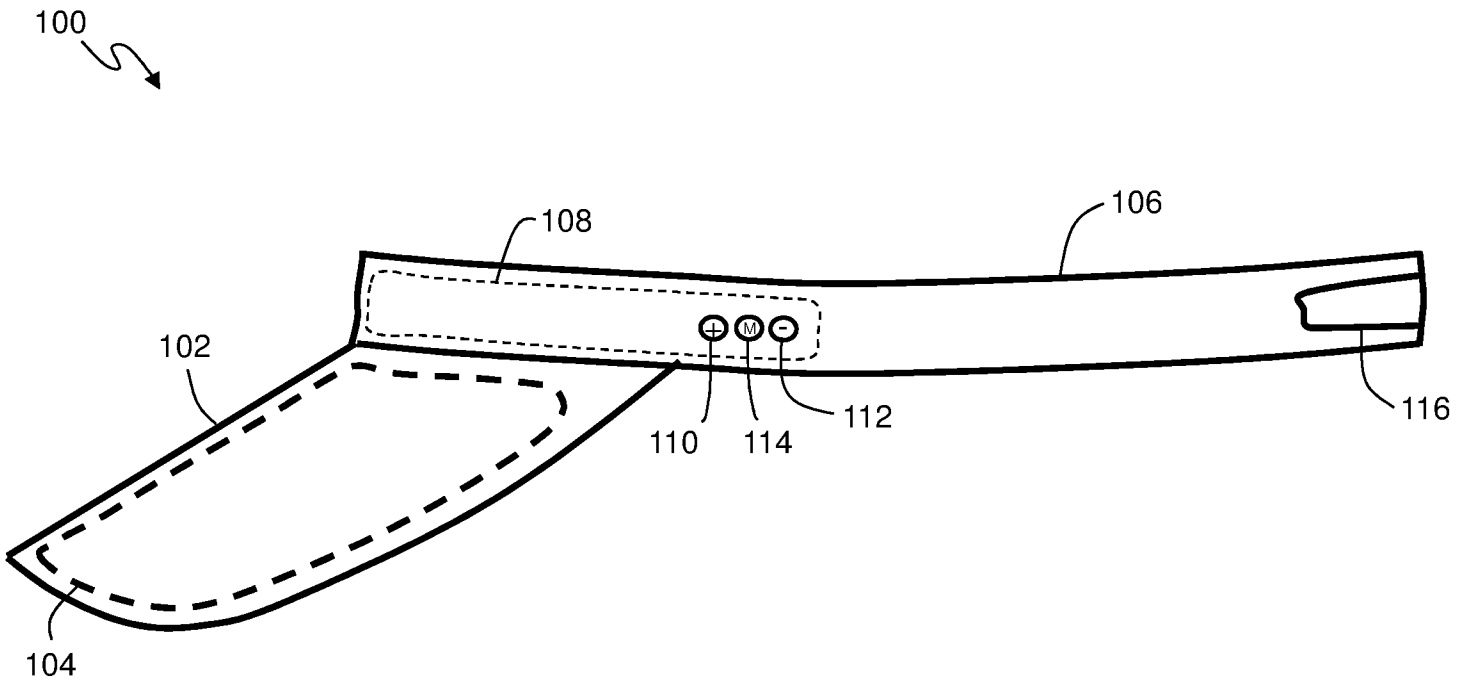
FIG. 1 is a diagram depicting a side view of an example wearable personal sound speaker system according to embodiments of the present invention.

Turning to FIG. 1, a side view of an example wearable personal sound speaker system 100 is shown. In the example embodiments shown, the wearable personal sound speaker system 100 includes a bill 102 with one or more integrally formed speaker elements 104. The bill 102 may be supported by a headband 106 that includes a sound source assembly 108. The headband 106 may be constructed of a light-weight, breathable fabric that is washable. In some embodiments, the headband 106 may include a removable, washable liner (not shown). The sound source assembly 108 may include one or more control mechanisms such as an up/forward/next button 110, a down/back/previous button 112, and/or a power/mode button 114. The control mechanism buttons 110, 112, 114 may be adapted to be operable to allow the user to control the sound source assembly 108. In some embodiments, the control mechanisms 110, 112, 114 may be covered by a flap (not shown) or disposed within the fabric of the band 106. In some embodiments, the headband 106 may include an elastic element and/or may include an adjustable fastening device 116 such as a hook and loop mating material, a clip, or buckle.

Figure 2:
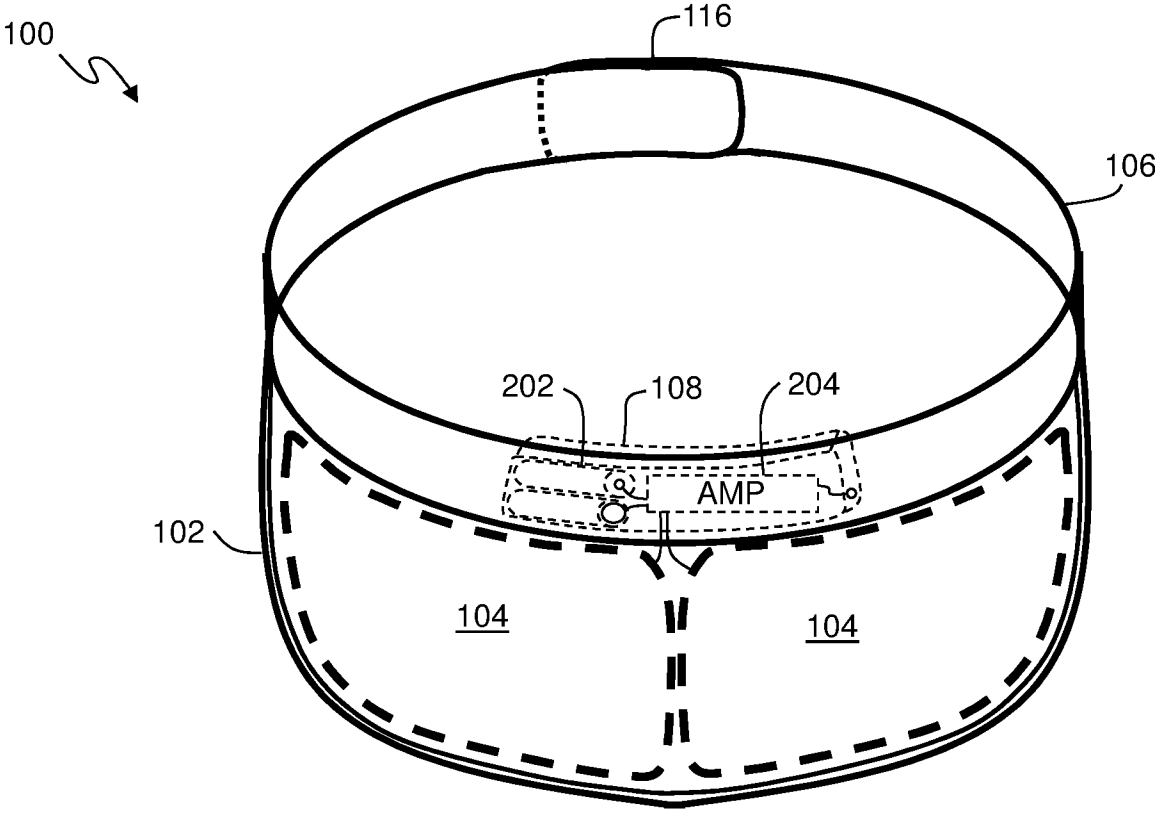
FIG. 2 is a diagram depicting a top perspective view of an example wearable personal sound speaker system according to embodiments of the present invention.

Turning to FIG. 2, a top perspective view of the example wearable personal sound speaker system 100 is shown. In this view, the control mechanisms 110, 112, 114 are not represented but additional elements of the sound source assembly 108 are depicted with hidden lines. As shown in FIG. 2, the sound source assembly 108 may include a power source 202 (e.g., batteries) and a sound processing circuitry 204 (e.g., an amplifier, wiring, transmitter, receiver, audio input, etc.) In some embodiments, the sound source assembly 108 may extend across the front of the headband 106 to the sides of the headband 106. In other embodiments, the sound source assembly 108 may be disposed only in the front of the headband 106 with a connection (e.g., one or more wires) extending to the control mechanisms 110, 112, 114 on the side of the headband 106.

As shown in FIG. 2, the wearable personal sound speaker system 100 may include two separate speaker elements 104. The separate speaker elements 104 may be coupled to the sound source assembly 108 and adapted to play two channels (e.g., left and right) of stereo sound from the sound source assembly 108. In some embodiments, the bill 102 may also include one or more microphones (not shown) also coupled to the sound source assembly 108 and adapted to allow the system 100 to receive audio (e.g., stereo) input.

Figure 3:
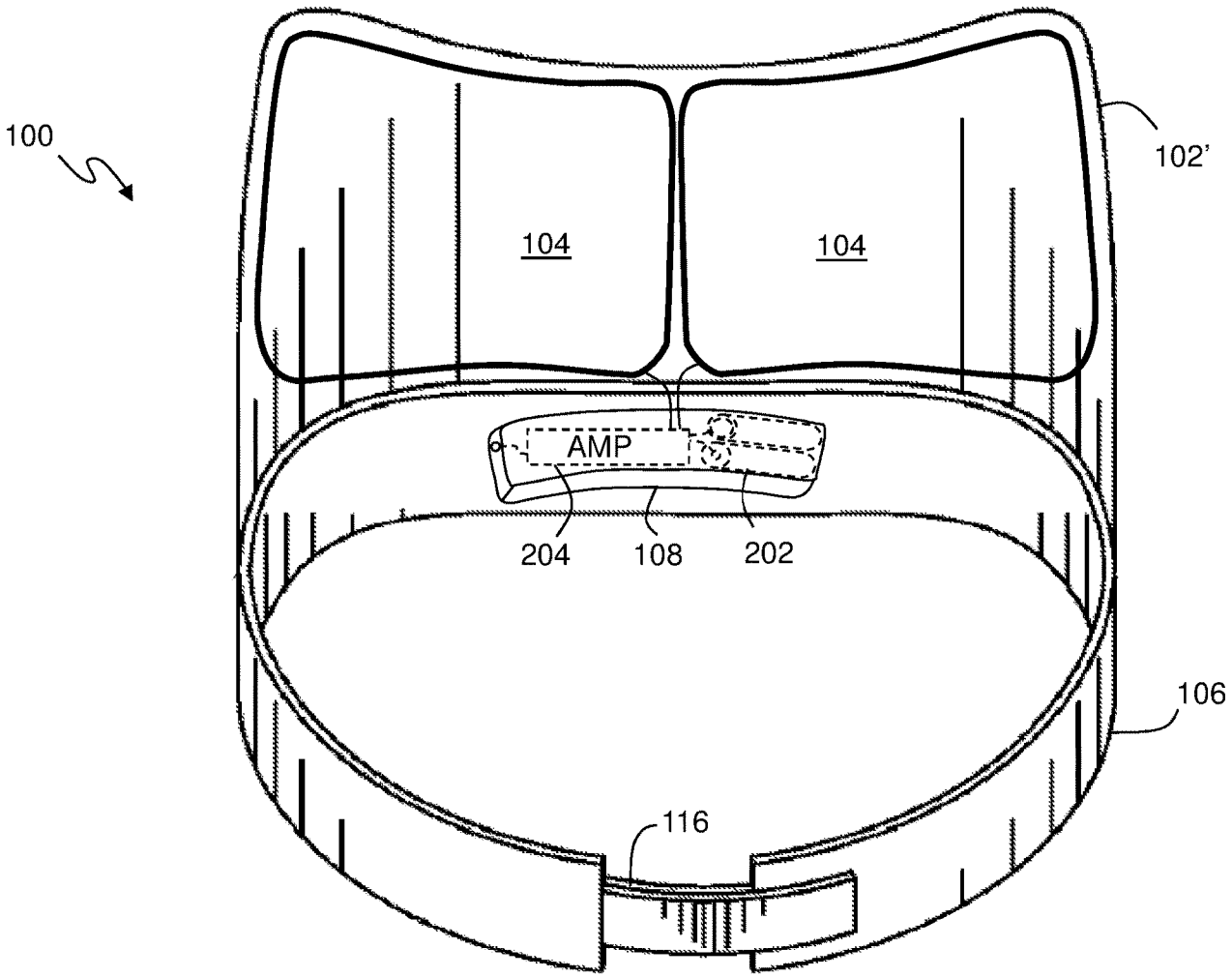
FIG. 3 is a diagram depicting a bottom perspective view of an example wearable personal sound speaker system according to embodiments of the present invention.

Turning now to FIG. 3, a bottom perspective view of an example embodiment of a wearable personal sound speaker system 100 with an alternate bill 102' is shown. The alternate bill 102' has an alternate shape that maybe better suited for forming the integral speaker elements 104. Note that in some embodiments the speaker elements 104 may have any shape that is practicable for the uses described herein and in particular for creating direct sound as discussed below.

Figure 4:
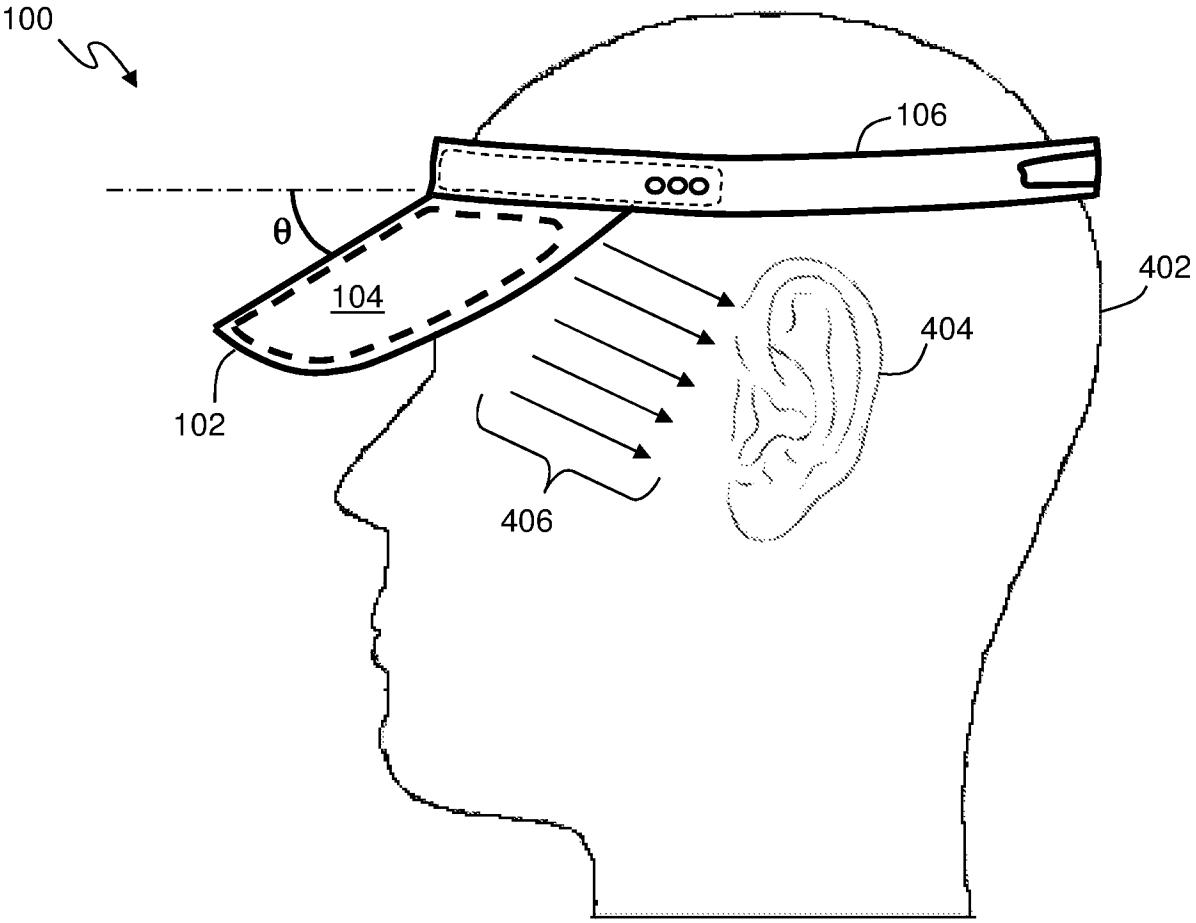
FIG. 4 is a diagram depicting a side view of an example wearable personal sound speaker system being worn according to embodiments of the present invention.

Turning now to FIG. 4, an example embodiment of a wearable personal sound speaker system 100 is depicted worn on an example human head 402. Note that the bill 104 is specifically disposed to aim the speaker elements 104 (only one visible) at the ears 404 of the wearer. As indicated by arrows 406, directed sound is aimed at the wearer's ears 404. This is achieved by using, for example, flexible speakers such as those manufactured by Verisonix Corporation of Taipei, Taiwan or the model TLF type speakers manufactured by Yamaha Corporation of Tokyo, Japan. In addition, the angle theta (θ) may be selected such that the speaker elements 104 are properly positioned and aimed.

In some embodiments, a visor or a cap may include a headband with an adjustable strap; a bill attached to the headband and including an flexible fabric sound speaker integrally formed within the bill; an amplifier including a signal input, the amplifier removeably attached to the headband and coupled to the speaker; and a power supply removeably attached to the headband and coupled to the amplifier.

The visor may also include a signal source removeably attached to the headband and coupled to the signal input of the amplifier. The signal source may include a signal receiver. The flexible fabric sound speaker may span the width and length of the bill. The bill may be separable from the headband. The headband may include a removable liner formed from a moisture absorbing and washable material. The headband may be formed from light weight material adapted to allow air to pass through. The adjustable strap may include a mating hook and loop material such as Velcro®. The flexible fabric sound speaker may include a first and a second portion where the first portion is coupled to a first channel of the amplifier and the second portion is coupled to a second channel of the amplifier. The first portion may be disposed on a first side of the bill; the second portion may be disposed on a second side of the bill; and together the first and second portions may be adapted to reproduce stereo sound. The amplifier and the power supply may be contained in a single housing. The housing maybe water tight and include externally accessible waterproof controls adapted to be accessible while the housing is removeably attached to the visor. The externally accessible controls may include a switch operable to activate playback of a predefined music selection. The externally accessible controls may include a switch operable to allow selection of a predefined sound level. The housing may be positioned to not be visible while the visor is worn by a user. The amplifier may be coupled to the speaker via a moisture resistant connection that is not visible while the visor is worn by a user. The signal source may include a signal receiver and a signal transmitter. The visor may also include a microphone removeably attached to the headband and coupled to the transmitter. The signal receiver and transmitter may include a Bluetooth® protocol device and the Bluetooth® protocol device is adapted to use the speaker and the microphone while paired with a wireless phone.

In some embodiments, the visor or a cap may include a headband with an adjustable strap; a bill attached to the headband and including a directional ultrasonic transducer or a directional flexible speaker element integrally formed within the bill; an amplifier attached to the headband and coupled to the ultrasonic transducer or flexible speaker element; and a power supply attached to the headband and coupled to the amplifier.

Figure 5:
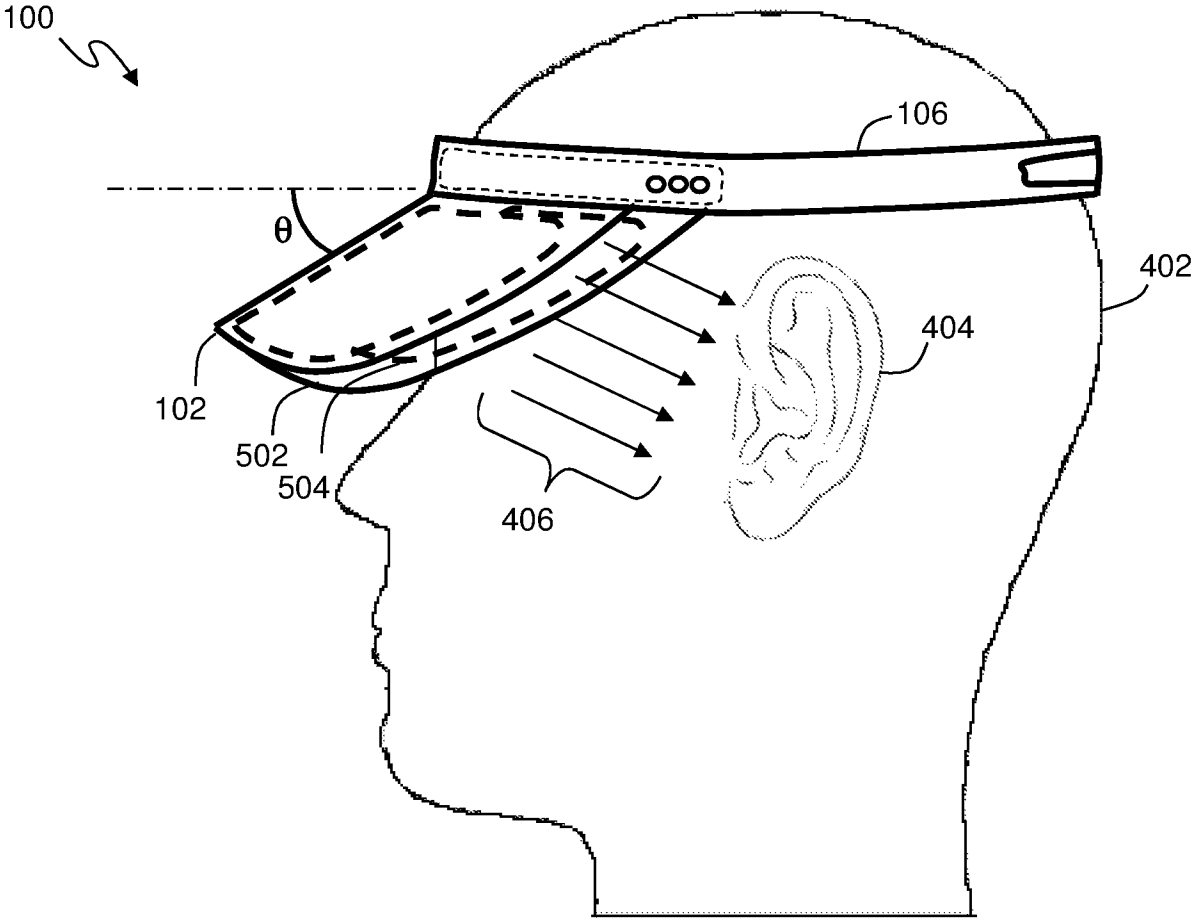
FIG. 5 is a diagram depicting a side view of an example wearable personal sound speaker system with an extended width bill being worn according to embodiments of the present invention.

Turning to FIG. 5, a side view of an example wearable personal sound speaker system 100 with an extended width bill 502 is shown. In some embodiments, the width of the bill 502 or rim of the visor (or cap) may be extended laterally to allow the curve and shape of the bill 502 to direct sound at the ears 404 of the wearer 402. In other words, the bill 502 maybe made wider than a conventional bill and/or wider than the wearer's head 402. In addition to widening the bill 502, the speaker elements 504 may be widened as well.

In some embodiments, the bill may include waterproof or water resistant material on a top surface that protects the speaker elements from moisture and sunlight. The bill may also or alternatively be coated with a protective material to provide water or light protection.

Figure 6:
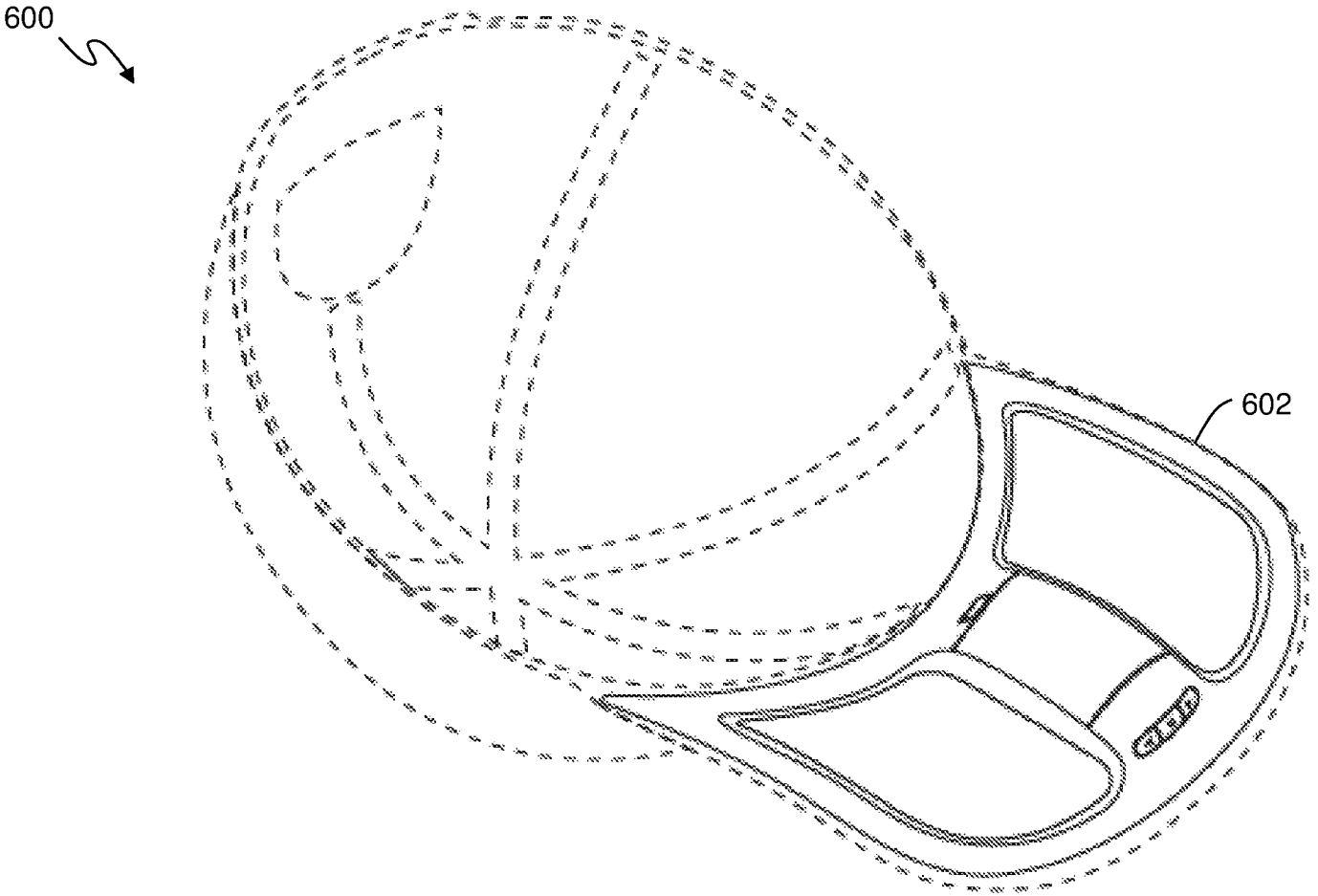
FIG. 6 is a diagram depicting a bottom perspective view of an example wearable personal sound speaker system according to embodiments of the present invention.
Figure 7:
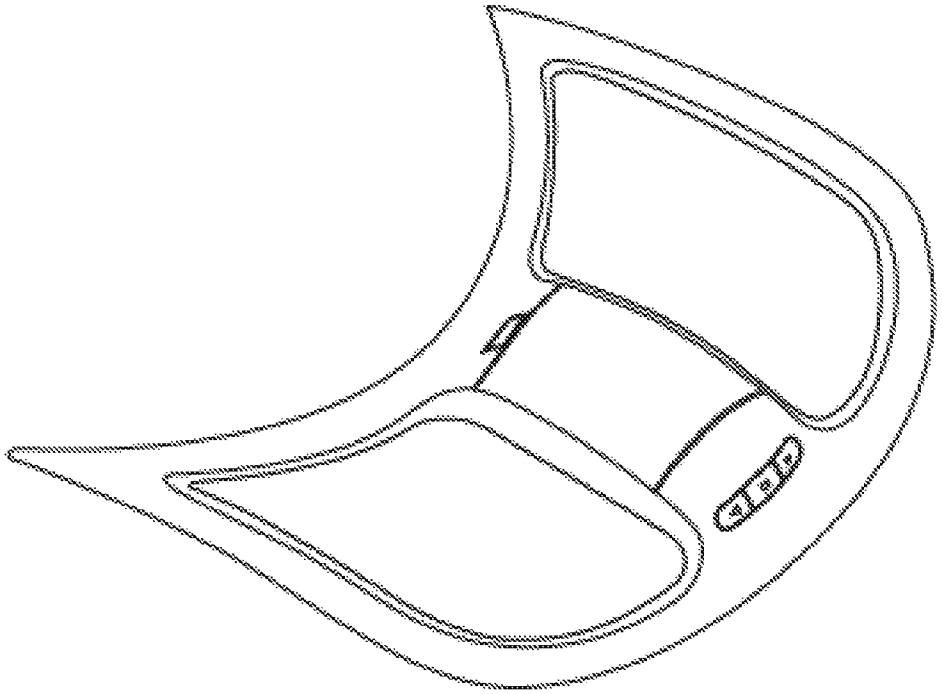
FIG. 7 is a diagram depicting a wearable personal sound speaker system kit attachable to a hat or visor according to embodiments of the present invention.
Figure 8:
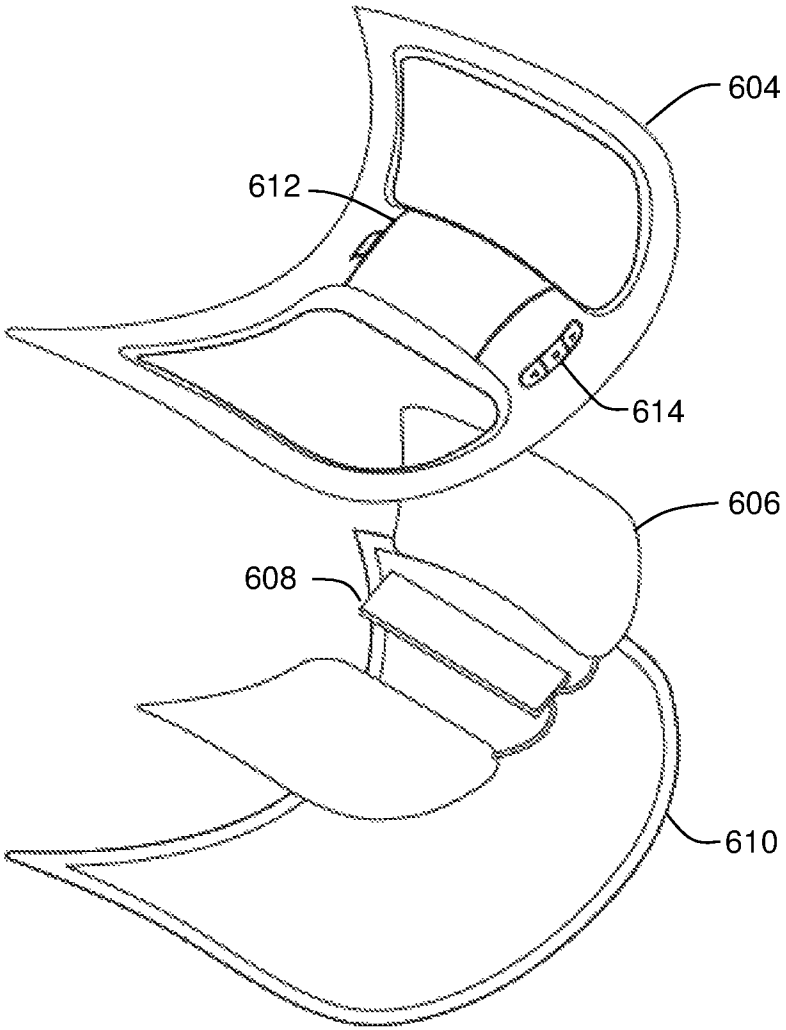
FIG. 8 is a diagram depicting an exploded view of a wearable personal sound speaker system kit according to embodiments of the present invention.

Turning to FIG. 6 an alternative embodiment of a wearable personal sound speaker system is shown. The system 600 can include a cap (shown in phantom) or visor with a self-contained sound unit 602 permanently or removeably attached to the bill of the hat. The sound unit 602 may include fasteners to attach to the bill. The sound unit 602 may include a signal source and/or a receiver as described above with respect to other embodiments. FIG. 7 depicts the sound unit 602 without the hat and FIG. 8 depicts an exploded view of the sound unit 602. The invention may be embodied as a self-contained kit that may be added or attached to any suitable hat or other item.

In some embodiments, the sound unit 602 can include a frame 604, speakers 606, electronics 608, and backing 610. The frame 604 can include openings for the speakers 606 and a compartment for the electronics 608, as well as an access door 612 and system control buttons 614 that can be wired (not shown) to the electronics 608.

Figure 9:
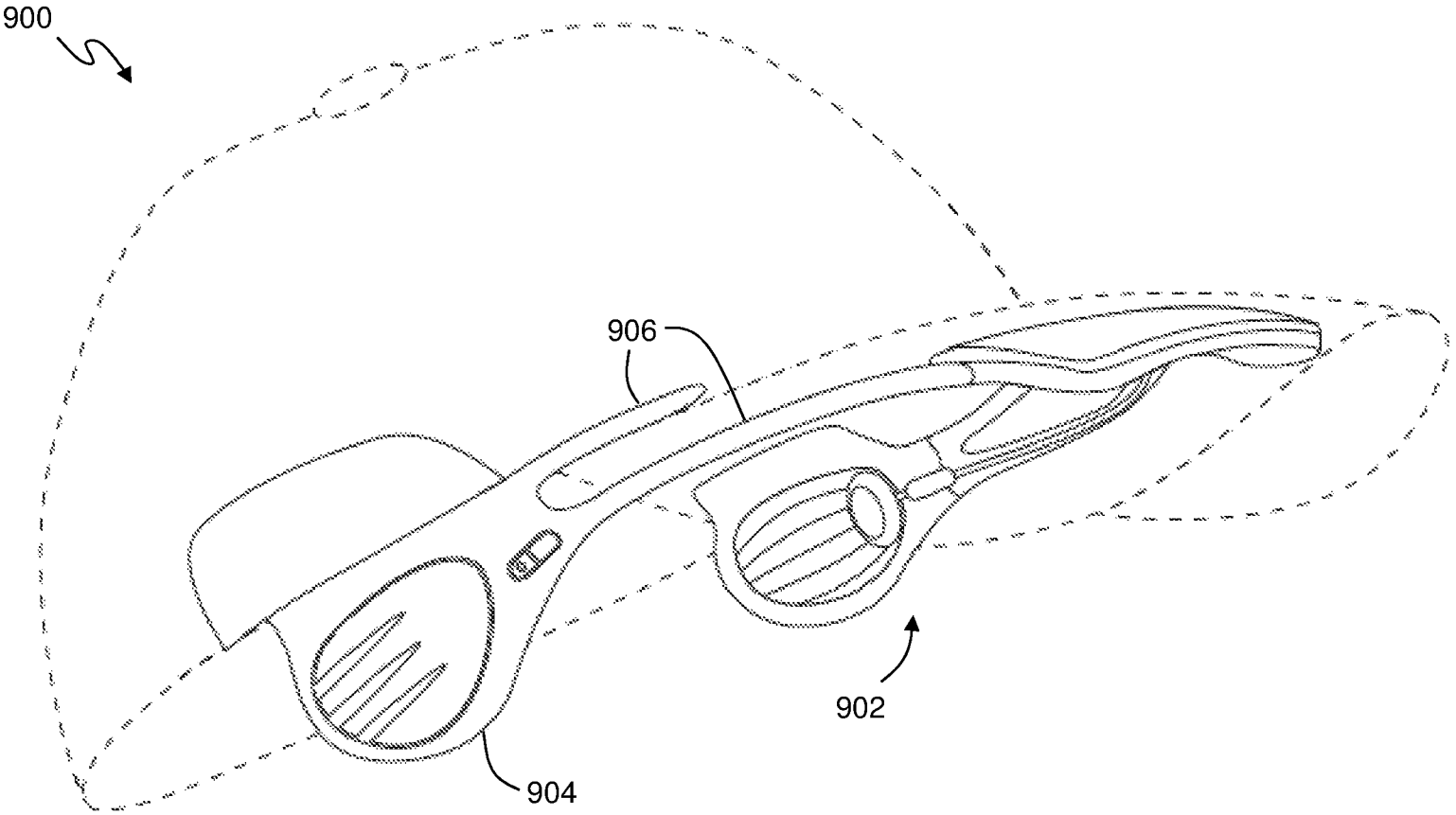
FIG. 9 is a diagram depicting a side perspective view of an example wearable personal sound speaker system according to embodiments of the present invention.
Figure 10:
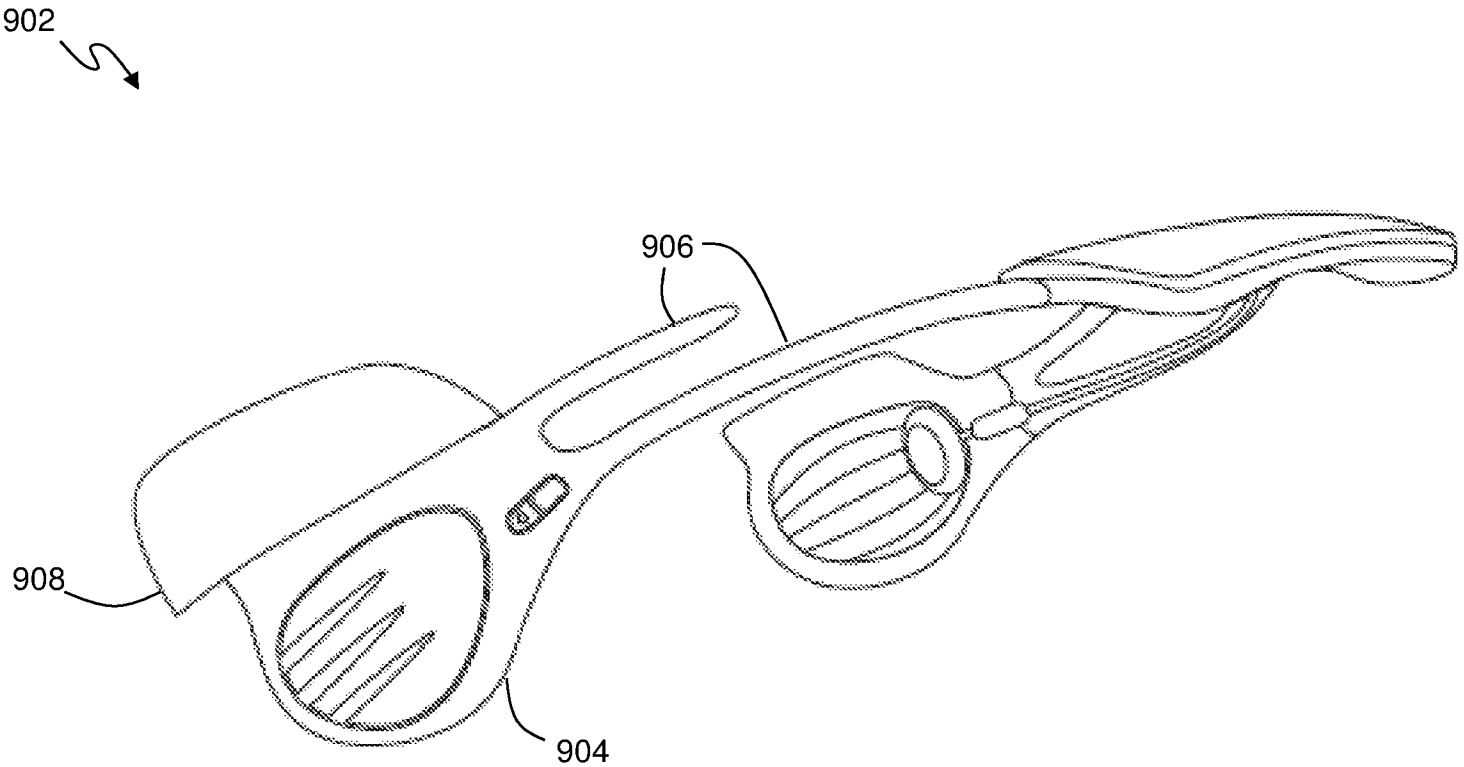
FIG. 10 is a diagram depicting a wearable personal sound speaker system kit attachable to a hat or visor according to embodiments of the present invention.
Figure 11:
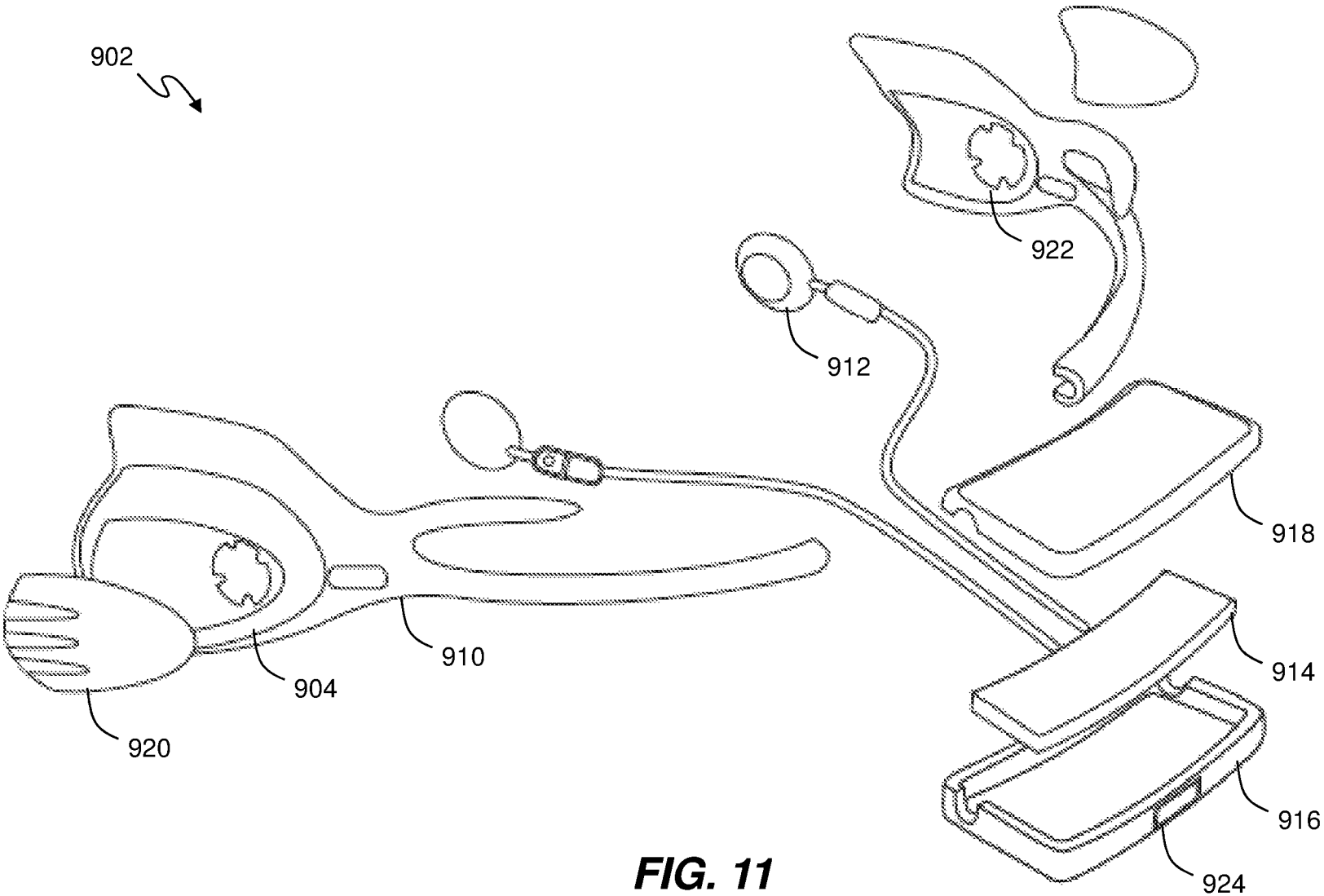
FIG. 11 is a diagram depicting an exploded view of a wearable personal sound speaker system kit according to embodiments of the present invention.

FIG. 9 is a diagram depicting a side perspective view of another alternative example of a wearable personal sound speaker system according to embodiments of the present invention. The system 900 can include a cap (shown in phantom) or visor with a self-contained sound unit 902 permanently or removeably attached to the bill and/or sides of the hat. The sound unit 902 may include fasteners to attach to the bill and/or sides of the hat. The fasteners may be embodied as fingers 906 that extend from sound guides 904 and clip or otherwise engage the bill of the hat. The fingers 906 may further include friction fit or snap fit couplings (not shown) to secure the sound unit 902 to the hat. In some embodiments, the sound unit 902 may include speakers, a signal source, and/or a receiver as described above with respect to other embodiments. In some embodiments, the sound unit 902 may only include the sound guides 904 and the fasteners (e.g., fingers 906) for attachment to a hat. In such embodiments, a user may add ear-bud style speakers or other types of speakers to the sound unit 902. FIG. 10 depicts the sound unit 902 without the hat and FIG. 11 depicts an exploded view of the sound unit 902. The invention may be embodied as a self-contained kit that may be added or attached to any suitable hat or other item and/or have a sound system added to it.

In some embodiments, the sound unit 902 can include additional fasteners (e.g., clips 908) for attaching to the inner folds or hem of the hat. In some embodiments, the sound unit 902 can include two wings 910 each including a sound guide 904, speakers 912, electronics 914, electronics compartment 916, and door 918. In some embodiments, the sound guide 904 can include removeable access panels 920. These panels 920 can include fashionable shapes, colors and/or designs including logos or other marks. The panels 920 permit access to the interior of the sound guides 904 to allow a manufacturer or user to more easily install speakers 912 within the sound guides 904. The sound guides 904 may include fasteners 922 (e.g., snap fit or friction fit couplings) that allow the speakers 912 to be held securely within the sound guides 904 and to be positioned to optimally aim sound into the sound guides and/or the user's ears. The sound guides 904 may be shaped to provide a passageway that amplifies and/or directs sound from the speakers 912 to the user's ears. The sound guides 904 may further include material to also aid in directing desired frequencies to the user's ears.

In some embodiments, the wings 910 may be permanently or removeably attached to the electronics compartment 916. The electronics compartment 916 may include a control panel 924 for controlling the electronics 914.

Turning now to FIGS. 12 to 21B, in some embodiments, the invention can include a wearable personal sound speaker system kit for mounting the speakers of an existing audio device onto head or neck worn items such as headbands, glasses, googles, hair clips, barrettes, hair bands, hair claws, hair pins, bobby pins, bandanas, head wraps, scarfs, turbans, hats, caps, visors, tiaras, crowns, laurel wreath, braces, headgear, helmets, faceguards, facemasks, neck braces, eye guards, masks, or other items. The speakers can be any type of relatively small, lightweight speakers such as headphone speakers, ear-bud speakers, earphone speakers, electrostatic speakers, etc.

Embodiments of the wearable personal sound speaker system kit can include two housings for the speakers that are adjustably connected to two attachment mechanisms (i.e., one housing connected to one attachment mechanism) for coupling the kit to the worn/wearable item (e.g., the brim of a cap, the frame of glasses, etc.). The housings can be funnel or cup shaped to direct sound toward the user's ears. The housings can include a speaker mounting system to releasably hold the speakers within the housings and to allow the speakers to be aimed at the user's ear canals. The speaker mounting system can include clips or clamps configured to friction fit to the speakers. An adapter or collar with a moldable pad that closely contours to the speaker can be provided that friction fits into the clips or clamps of the mounting system. Such a moldable pad allows many different size speakers to be securely held by the speaker mounting system. The housings can also include a channel for securing and routing wires connecting to the speakers. In some embodiments, the housings can be made from acrylonitrile butadiene styrene (ABS), polyethylene, polypropylene, polystyrene, or polyvinyl chloride plastic or any other lightweight practicable materials.

In some embodiments, the housings can each include a removable access panel. The access panel can provide an opening in the housing to make it easier to install the speakers in the housings. The access panels can be adapted to snap fit into openings in the housing. The access panels can include decorative features such as a product logo or other graphic images. Different color access panels can be provided with different decorative features to change the look of the kit to suit individuals' preferences. In some embodiments, the access panels can be disc shaped, oval shaped, or have other shapes. In some embodiments, the access panels can include three dimensional designs or textures such as grooves, patterns, logos, or other shapes.

The housing can be coupled to the attachment mechanism via a connector. The connector can be adjustable and adapted to allow the housing to be positioned relative to the ear of the user as desired. An adjustable connector allows the housing to be moved away from or toward the ear or anywhere in between, above or below the ear or anywhere in between, in front of or behind the ear or anywhere in between, and rotated parallel to or perpendicular to the ear or anywhere in between. The adjustable connector can include a flexure bearing which can be embodied, for example, as a rubber coated or encased bendable metal wire that holds its position after being bent. The flexure bearing allows the housing to be moved up, down, laterally and rotationally relative to the user's ear when the kit is mounted on a worn item. The adjustable connector can also include a slide bearing which allows the housing to be translated toward or away from the attachment mechanism. The slide bearing can be embodied as a carriage or member constrained to move in a channel. Any practicable slide bearing made of any practicable material can be used however. The slide bearing can include stops (e.g., detents) to define discrete positions of extension so users can find a position adjustment that works best for them and easily return to the same position later.

The attachment mechanism can be embodied as a clip or clamp that is releasably attachable to a portion of the worn item. For example, the attachment mechanism can be a clip that snuggly fits on a hat brim or eyeglass frame. In embodiments using a clip, the clip can include a gap suitable to snuggly fit the brim of a cap. The gap can include, for example, a studded, barbed, or rubber liner to further enhance the griping ability of the clip. In addition, the clip can include a spring bias to grasp the worn item. The clip can be embodied as a metal fold attached to a plastic frame of the attachment mechanism or the clip can be integrally formed from the frame of the attachment mechanism.

In some embodiments, the attachment mechanism can include an adjustment to more securely attach the mechanism to the worn item. For example, a threaded clamp that can be tightened can be used. The attachment mechanism can be embodied as numerous alternative fastening means including Velcro®, hook and loop, buttons, snaps, pins, rivets, friction fit devices, clasps, hook and eye, buckle, toggle, frog, clinch, tie, drawstring, zipper, laces, magnet, twist-tie, etc.

In some embodiments, the components of the wearable personal sound speaker system kit (e.g., the housing, the adjustable connector, and the attachment mechanism) can be coupled together using snap fit fittings, epoxy, welding, or any other practicable fastening means. In alternative embodiments, the kit may only include the housing with an integrally formed attachment mechanism. For example, the attachment mechanism can be a clip extending from the housing that attaches to a hat hem or headband. In some embodiments, instead of attaching to a worn item, the wearable personal sound speaker system kit can attach to the user. For example, the housing can include an attachment mechanism that loops over the users ear or clips to the user's hair (e.g., a braid or lock of hair).

Figure 12:
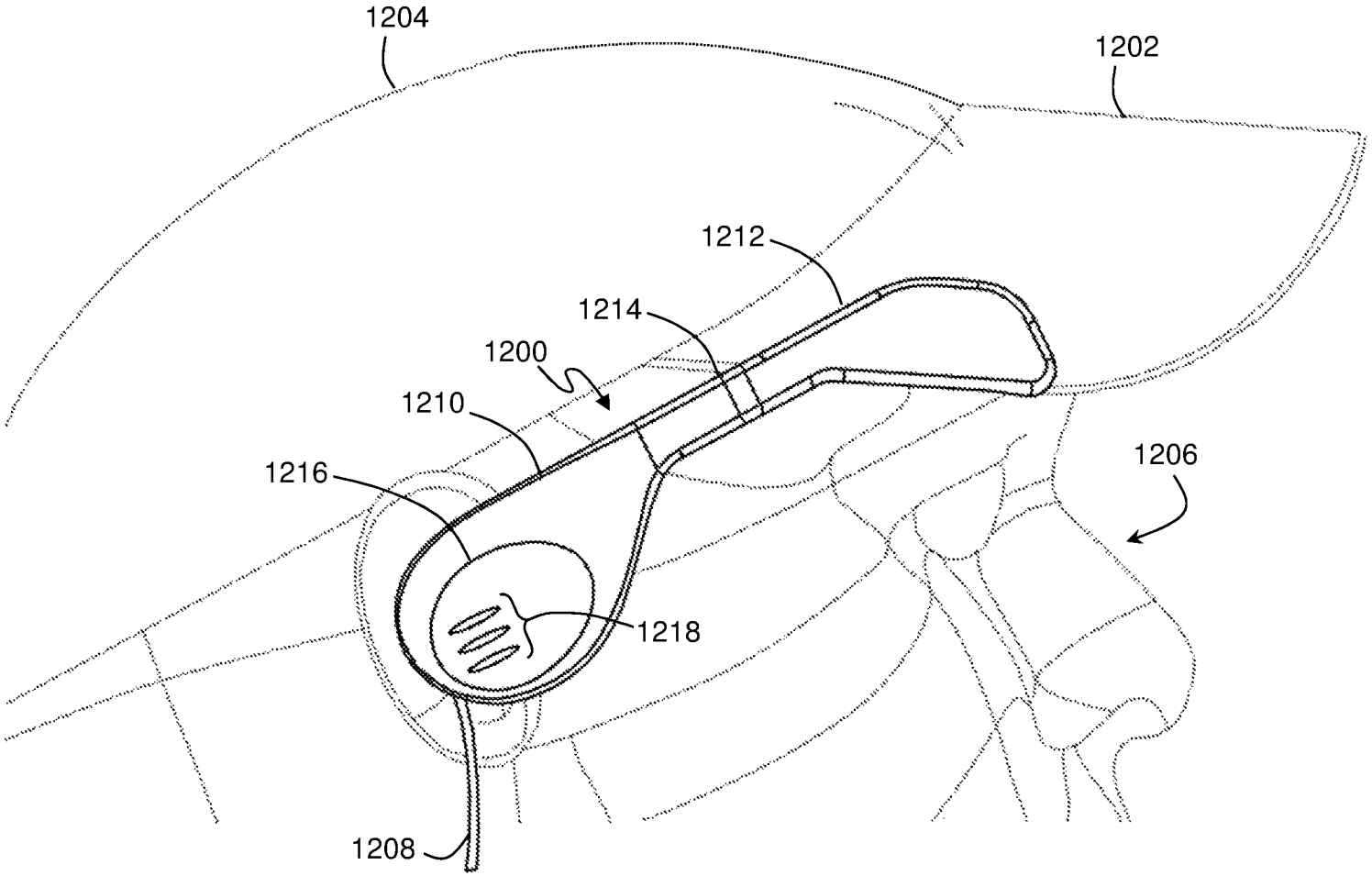
FIG. 12 is a diagram depicting a perspective view of one side of an alternative wearable personal sound speaker system kit installed on a cap according to embodiments of the present invention.

Turning now to FIG. 12, a perspective view of one side of an alternative wearable personal sound speaker system kit 1200 installed on the brim 1202 of a cap 1204 (shown in phantom) and worn by a user 1206 is depicted. A mirror image of the kit 1200 shown can be worn on the other side of the user's head. A speaker wire 1208 is visible leading down from the speaker housing 1210 to a sound signal source (not shown) such as an MP3 player, iPod®, smartphone, radio, etc. or to a device such as the BackBeat® GO 2 Bluetooth® Wireless Stereo Earbuds® manufactured by Plantronics Inc. of Santa Cruz, Calif. In the example embodiment shown in FIG. 12, the speaker housing 1210 is coupled to an attachment mechanism 1212 by an adjustable connector 1214. The example speaker housing 1210 shown includes an access panel 1216 that includes decorative grooves 1218.

Figure 13:
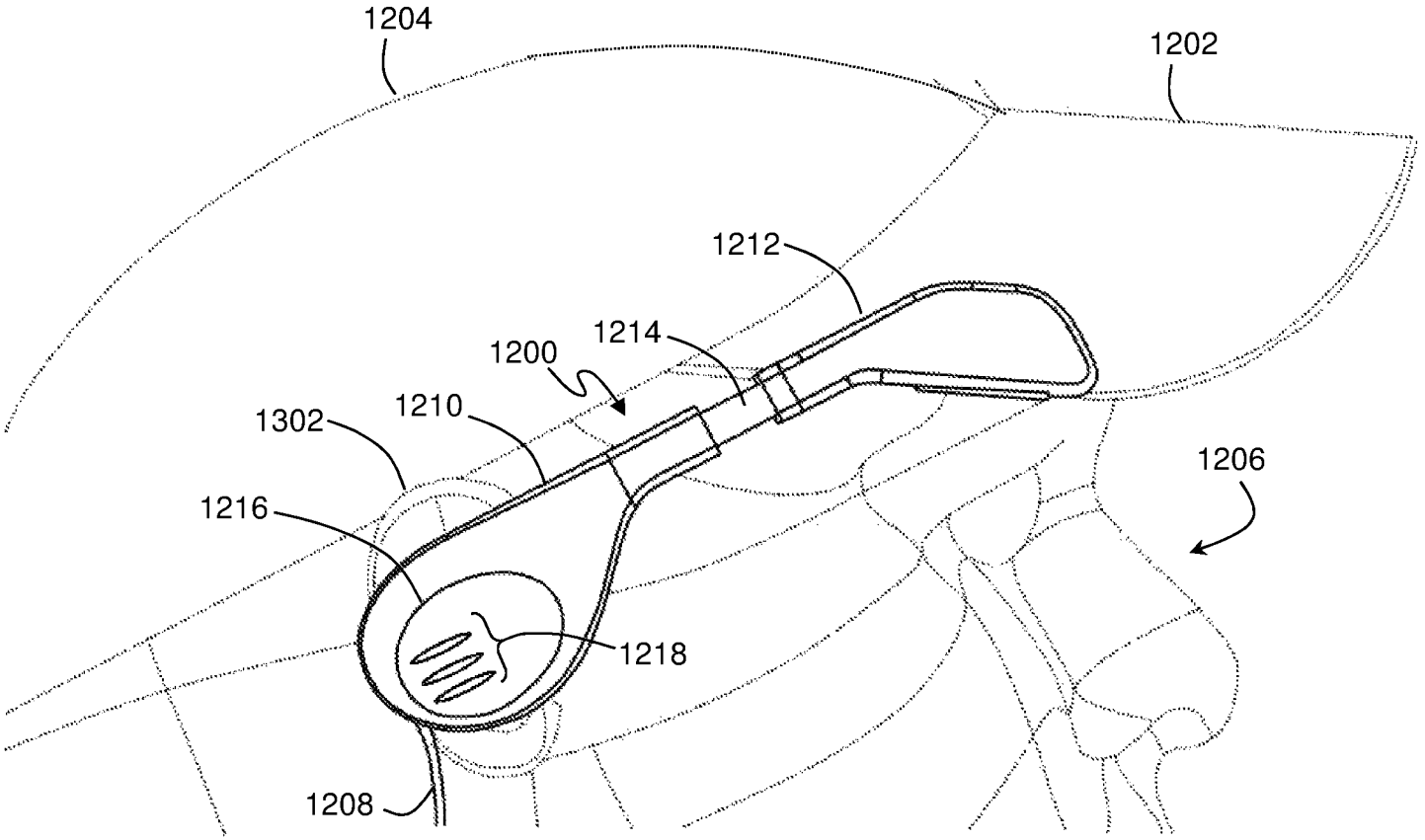
FIG. 13 is a diagram depicting a perspective view of the one side of the alternative wearable personal sound speaker system kit of FIG. 12 adjusted to direct sound towards the ear of the user according to embodiments of the present invention.
Figure 14:
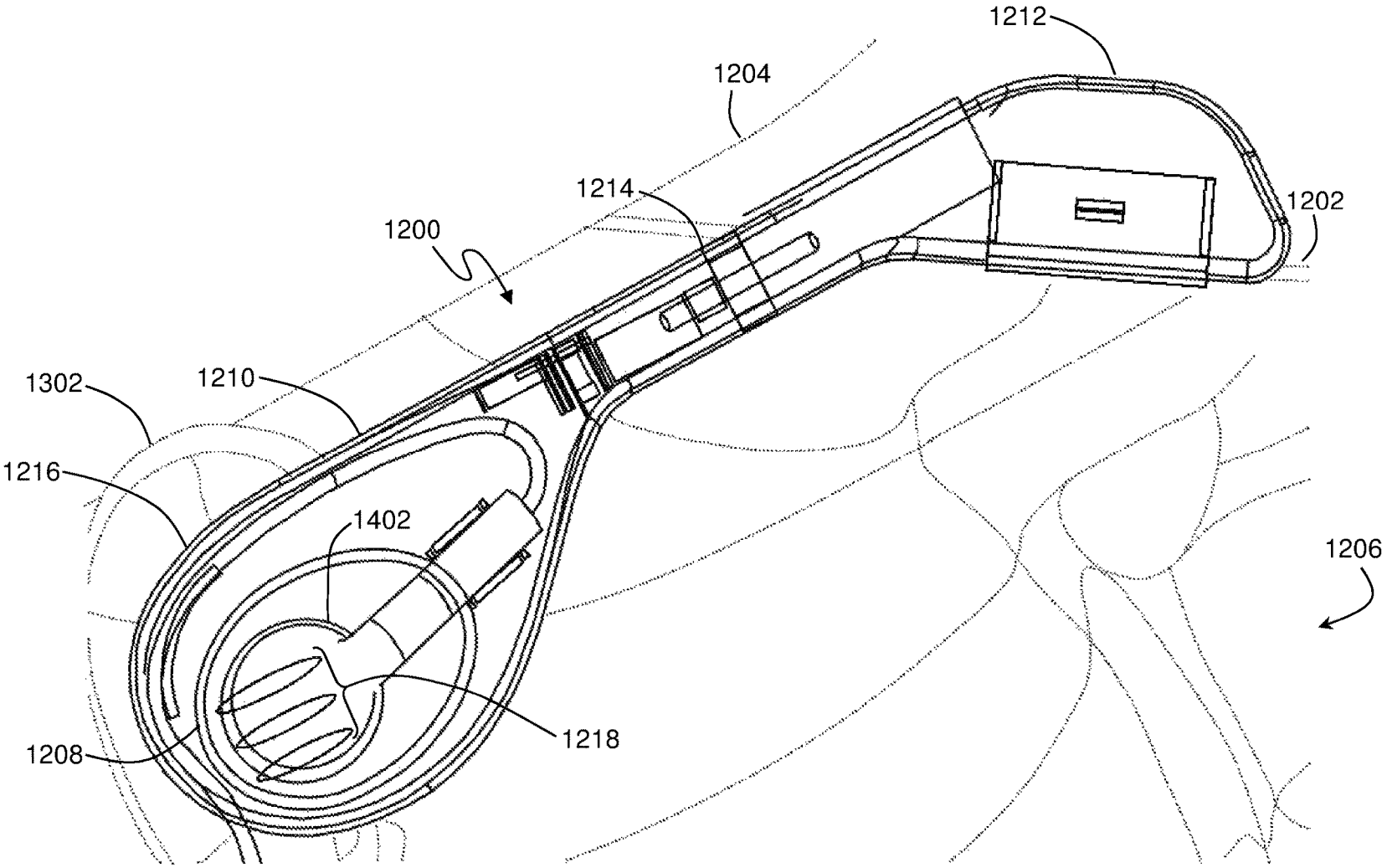
FIG. 14 is a diagram depicting a transparent wireframe view of the one side of the alternative wearable personal sound speaker system kit of FIG. 12 according to embodiments of the present invention.

FIG. 13 depicts a similar perspective view of as that of FIG. 12 but with the wearable personal sound speaker system kit 1200 adjusted to direct sound towards the ear 1302 canal of the user 1206. Note that the adjustable connector 1214 has been elongated so that the speaker housing 1210 can be shifted back to better align the speaker (not visible but see FIG. 14) with the user's ear canal. FIG. 14 depicts a magnified transparent "wireframe" view of the example kit 1200 embodiment of FIG. 12. This transparent view depicts the speaker 1402 installed in the housing 1210 and the routing of the speaker wire 1208 within the housing 1210.

Figure 15A:
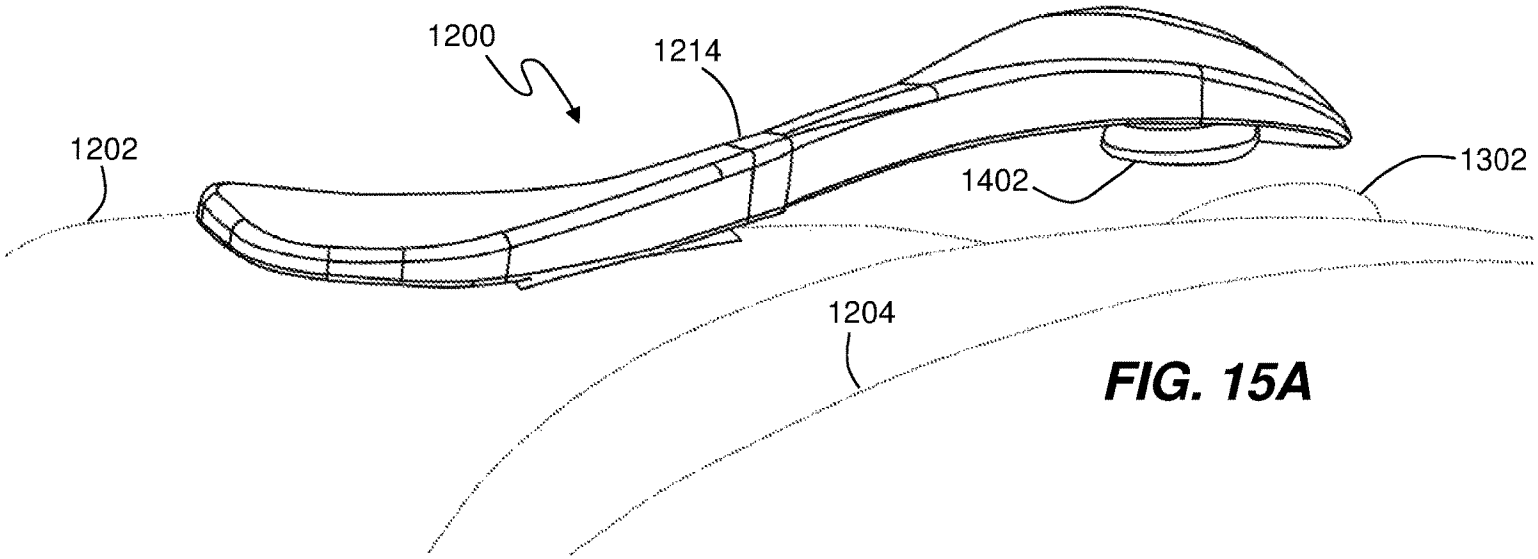
FIGS. 15A and 15B are top view perspective diagrams of the one side of the alternative wearable personal sound speaker system kit of FIG. 12 depicting aspects the system's adjustability relative to the user's ear according to embodiments of the present invention.
Figure 15B:
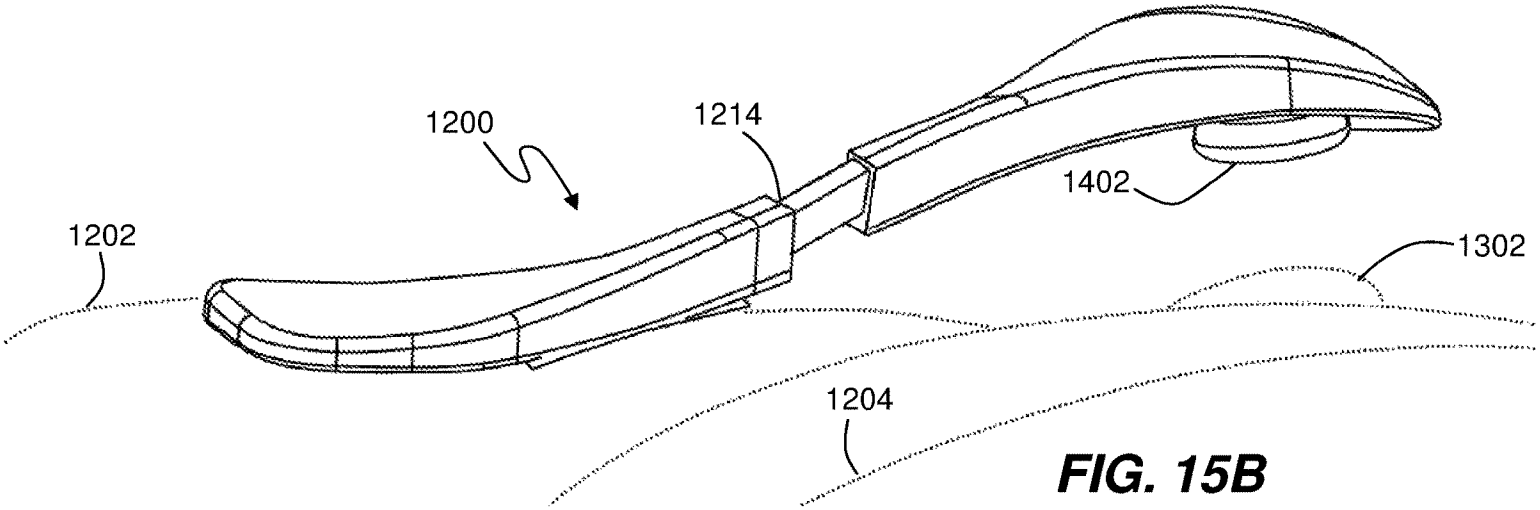

FIGS. 15A and 15B are top views of the wearable personal sound speaker system kit 1200 of FIG. 12. Relative to FIG. 15A, FIG. 15B illustrates that the adjustable connector 1214 allows the installed speaker 1402 to be adjusted away from the user's ear 1302 so that sounds from the surrounding environment can easily reach the user's ear 1302 without being blocked by the kit 1200. Note that the adjustable connector 1214 in FIG. 15B has been both elongated and bent to achieve the desired position relative to the user's ear 1302.

Figure 16A:
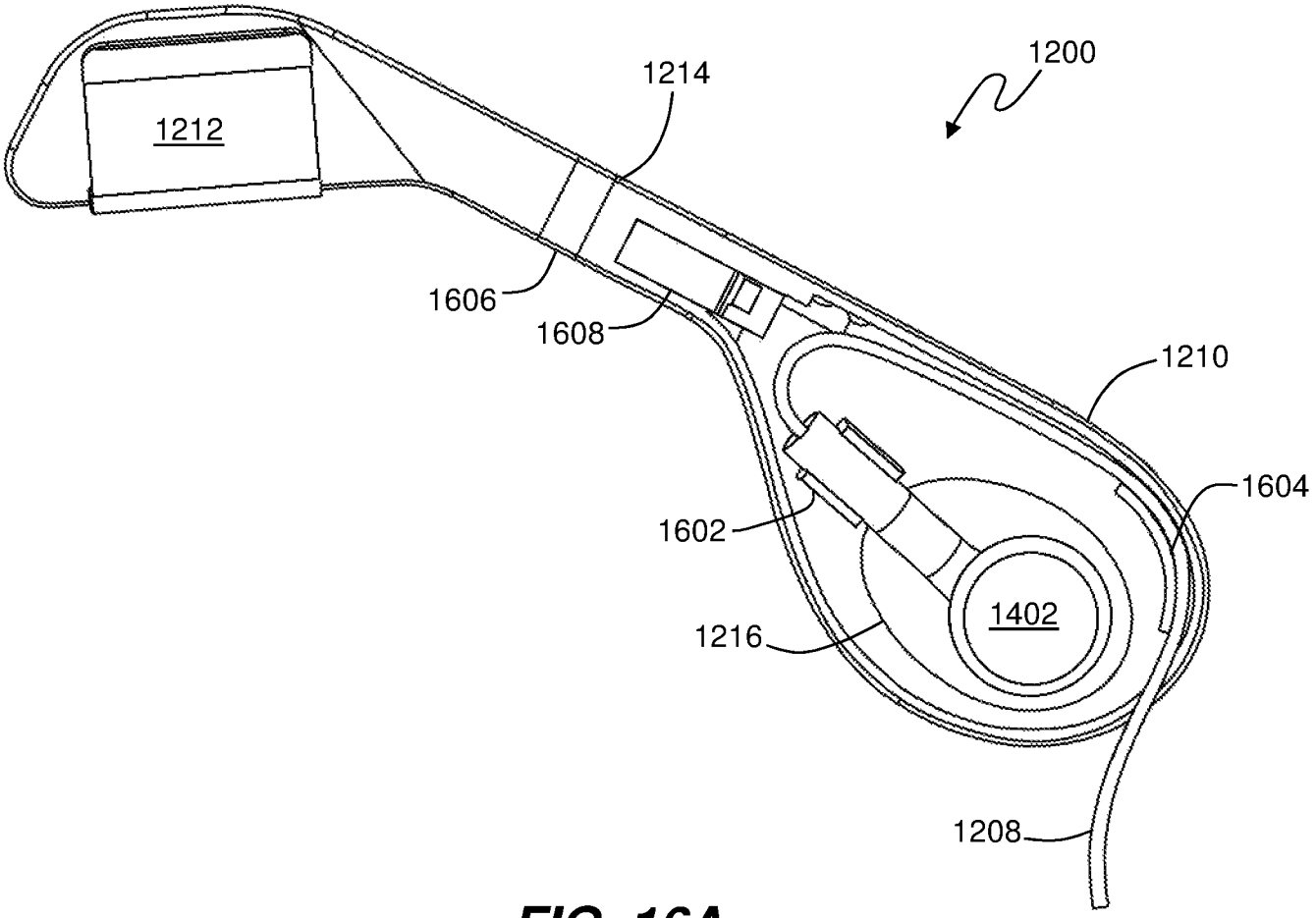
FIGS. 16A and 16B are inner side view perspective diagrams of the one side of the alternative wearable personal sound speaker system kit of FIG. 12 depicting aspects the system's adjustability according to embodiments of the present invention.
Figure 16B:
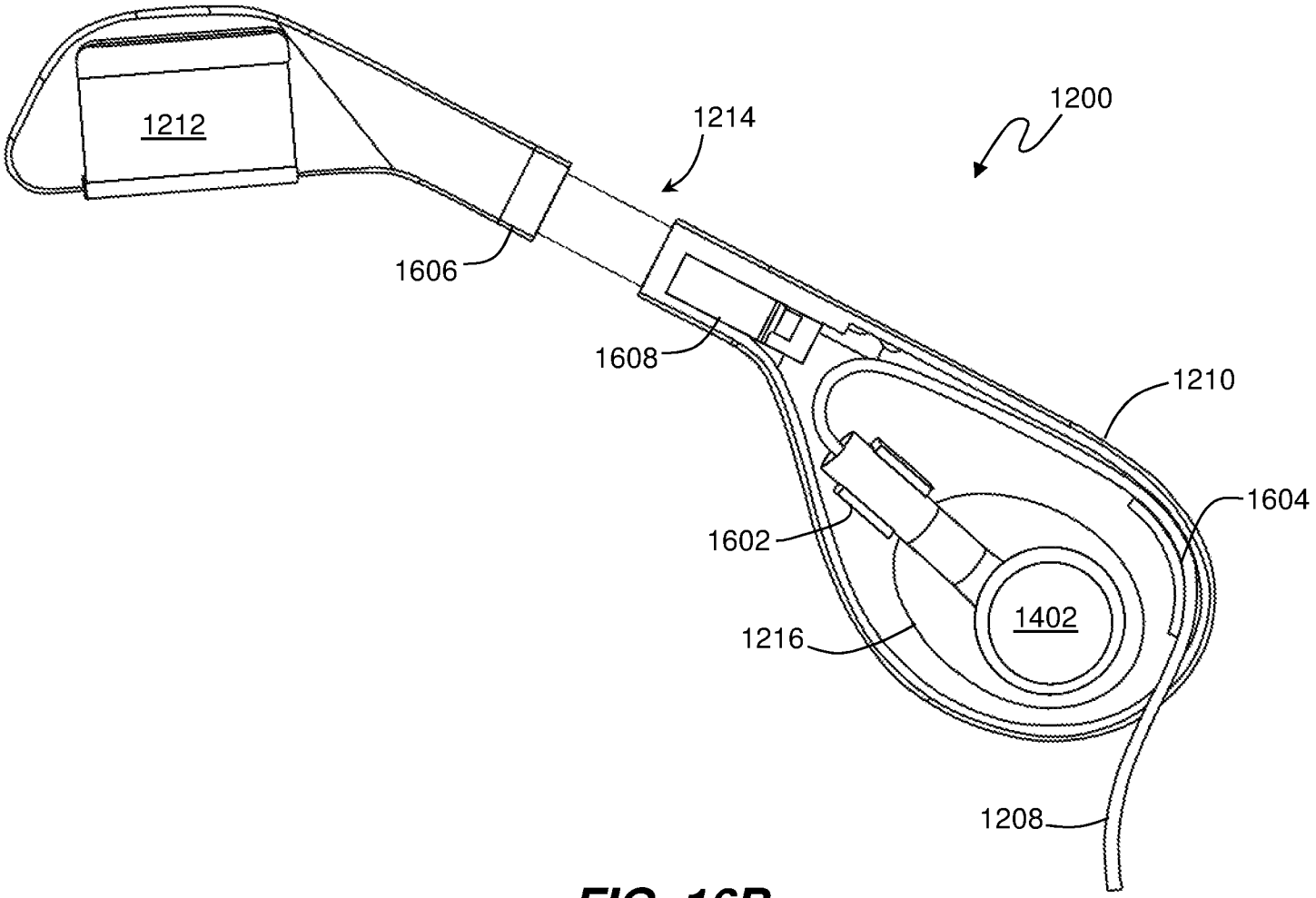

FIGS. 16A and 16B provide inner side views of the example embodiment of the wearable personal sound speaker system kit 1200 of FIG. 12. In addition to depicting further details of the features of the example embodiment, the two drawings also illustrate the system's adjustability relative to each other. For example, FIG. 16A depicts the kit 1200 compacted while FIG. 16B depicts the kit 1200 extended.

As shown, embodiments of the speaker housing 1210 can include a speaker mounting system 1602 to releasably hold the speaker 1402 within the housing 1210 and to allow the speaker 1402 to be aimed at the user's ear canals. The speaker mounting system 1602 can include a clip or a clamp configured to friction fit to the speaker 1402. Other alternative arrangements and fasteners can be used for the speaker mounting system 1602. For example, flexible (e.g., rubber) fingers or nubs can be used to secure the speaker 1402 to the housing 1210. Note that the speaker 1402 can be rotated within the speaker mounting system 1602 such that sound emanating from the speaker 1402 can be directed to the user's ear canal.

Embodiments of the speaker housing 1210 can also include a speaker wire channel 1604 to releasably hold the speaker wire 1208 within the housing 1210. As shown, the speaker wire channel 1604 can be embodied as a cable guide formed by a ridge or wall within the housing 1210 and an exterior wall of the speaker housing 1210. The speaker wire channel 1604 can also provide support for securing the speaker 1402 in the housing 1210 and also serve as a strain relief on the speaker wire 1208 connection to the speaker 1402. For example, if the speaker wire 1208 snags on something and pulls, instead of yanking the wire 1208 from the speaker 1402, the wire channel 1604 can be adapted to retain the wire 1208 to prevent any damage being done to the connection to the speaker 1402.

Embodiments of the adjustable connector 1214 can include a flexure bearing 1606 and a slide bearing 1608. As discussed above, the adjustable connector 1214 allows the housing 1210 to be moved away from or toward the ear or anywhere in between, above or below the ear or anywhere in between, in front of or behind the ear or anywhere in between, and rotated parallel to or perpendicular to the ear or anywhere in between. The adjustable connector 1214 includes a flexure bearing 1606 which can be embodied, for example, as a rubber coated or encased bendable metal wire that holds its position after being bent. The flexure bearing 1606 allows the housing 1210 to be moved up, down, laterally and rotationally relative to the user's ear when the kit 1200 is mounted on the worn item. The adjustable connector 1214 can also include a slide bearing 1608 which allows the housing 1210 to be translated toward (e.g., as shown in FIG. 16A) or away from (e.g., as shown in FIG. 16B) the attachment mechanism 1212. The slide bearing 1608 can be embodied as a carriage constrained to move in a channel. Any practicable slide bearing 1608 made of any practicable material can be used however. The slide bearing 1608 can include stops (e.g., detents) to define discrete positions of extension so users can find a position adjustment that works best for them and easily return to the same position later.

Figure 17:
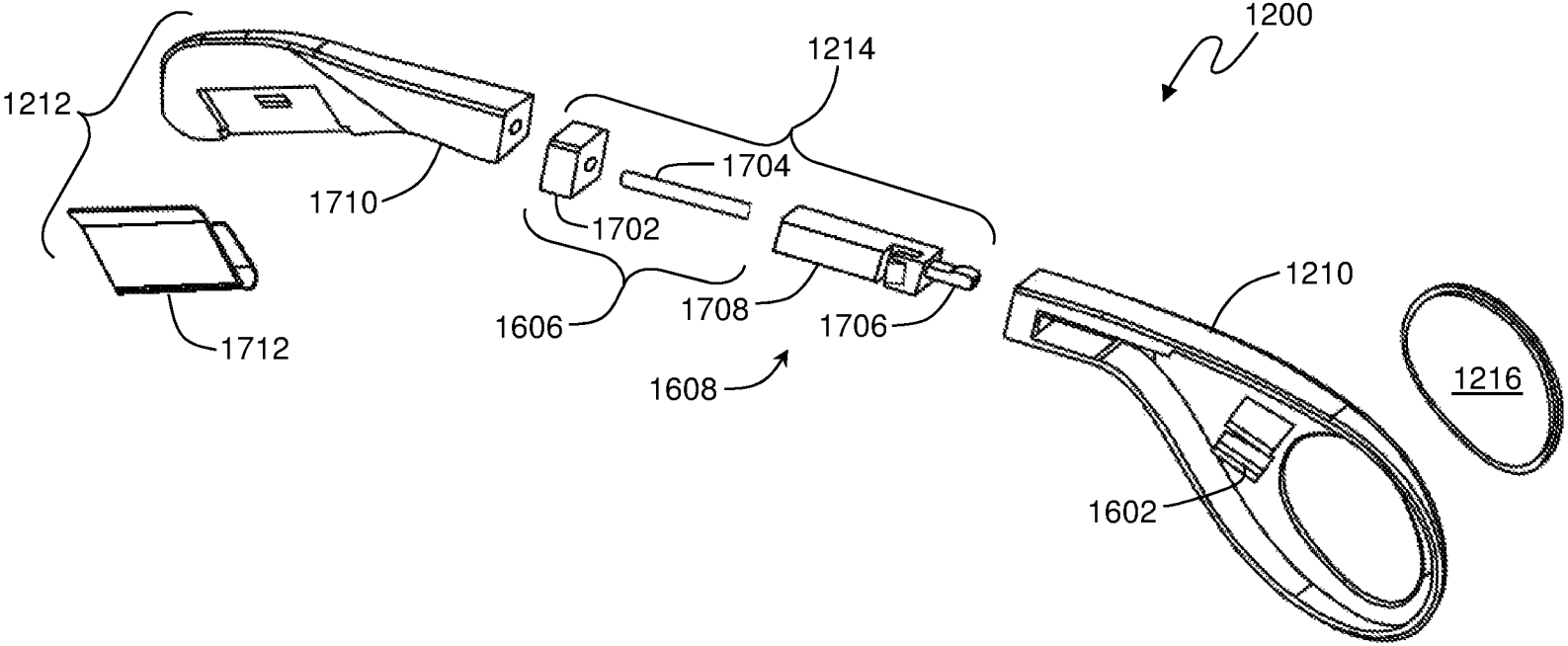
FIG. 17 is a diagram depicting an exploded view of the one side of the alternative wearable personal sound speaker system kit of FIG. 12 according to embodiments of the present invention.

FIG. 17 illustrates an exploded view of the wearable personal sound speaker system kit 1200 of FIG. 12. The access panel 1216 is shown separated from the speaker housing 1210 and the speaker mounting system 1602 can more clearly be seen without the speaker installed. Details of the features of the adjustable connector 1214 are also clearly depicted in the exploded view of FIG. 17. Other embodiments are possible. The example embodiment of the flexure bearing 1606 includes a foam rubber block 1702 and a bendable wire 1704. The example embodiment of the slide bearing 1608 includes a beam 1706 constrained to move in a channel 1708. Details of the features of the attachment mechanism 1212 are also clearly depicted in the exploded view of FIG. 17. Other embodiments are possible. The example embodiment of the attachment mechanism 1212 depicted in FIG. 17 includes an attachment frame 1710 adapted to couple to and support a metal fold clip 1712 having a spring bias.

Figures 18A, 18B:
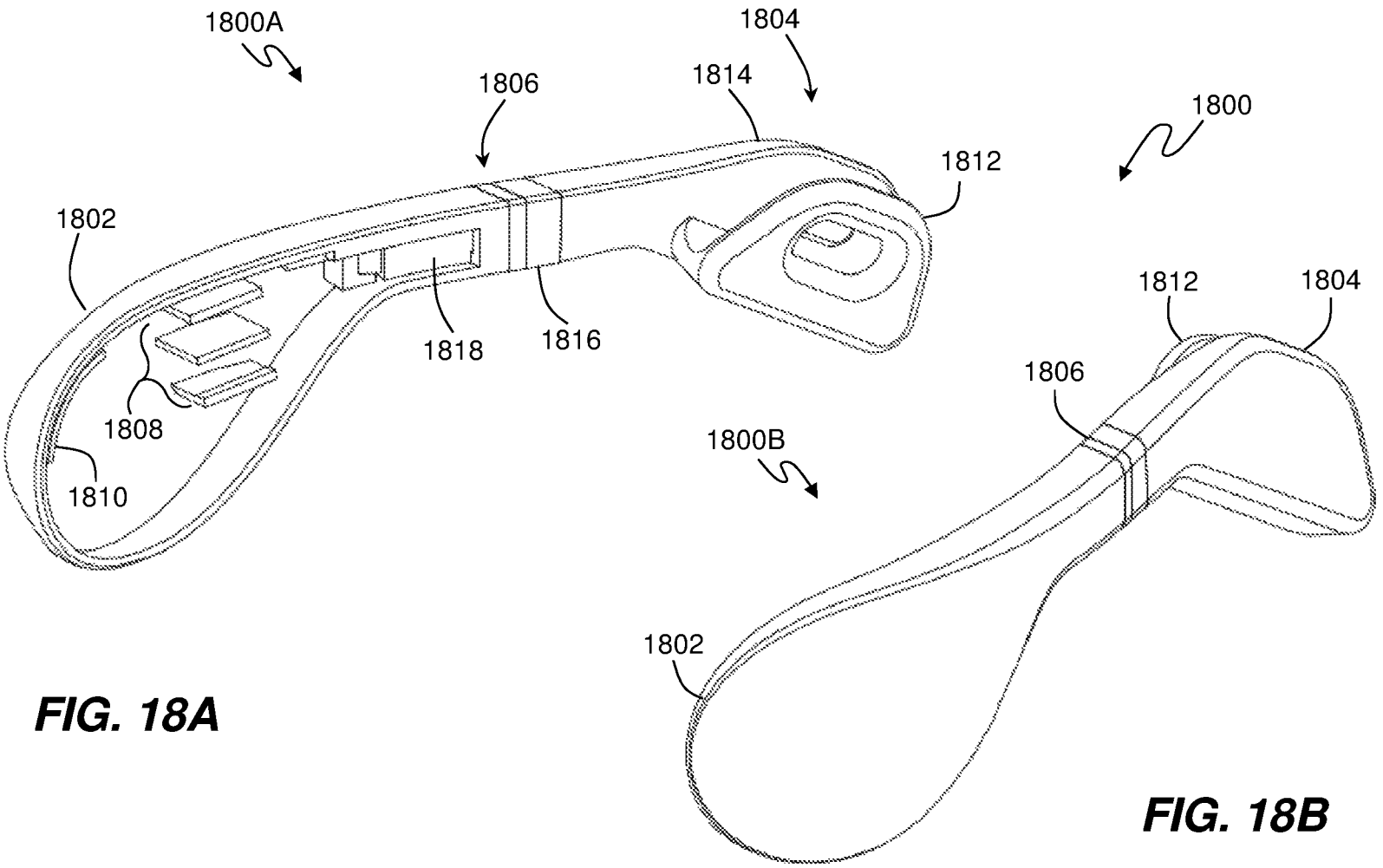
FIGS. 18A and 18B are perspective diagrams of the two sides of another alternative wearable personal sound speaker system kit according to embodiments of the present invention.

Turning now to FIGS. 18A and 18B, a second embodiment of a wearable personal sound speaker system kit 1800 is illustrated. FIGS. 18A and 18B provide perspective views of the two sides (e.g., left side 1800A in FIG. 18A and right side 1800B in FIG. 18B) of a wearable personal sound speaker system kit 1800 according to some embodiments. Note that the two sides 1800A, 1800B are mirror images of each other. The example embodiment of the kit 1800 includes a speaker housing 1802 coupled to an attachment mechanism 1804 via an adjustable connector 1806. The speaker housing 1802 includes a speaker mounting system 1808 and a speaker wire channel 1810. Note that the speaker mounting system 1808 of this embodiment is adapted to accommodate speakers of different sizes by including multiple griping fingers as well as a compliant adapter that will be described in more detail below. The attachment mechanism 1804 includes and integrally formed clip member 1812 that extends from the attachment frame 1814. The adjustable connector 1806 includes a flexure bearing 1816 and a slide bearing 1818.

Figure 19A:
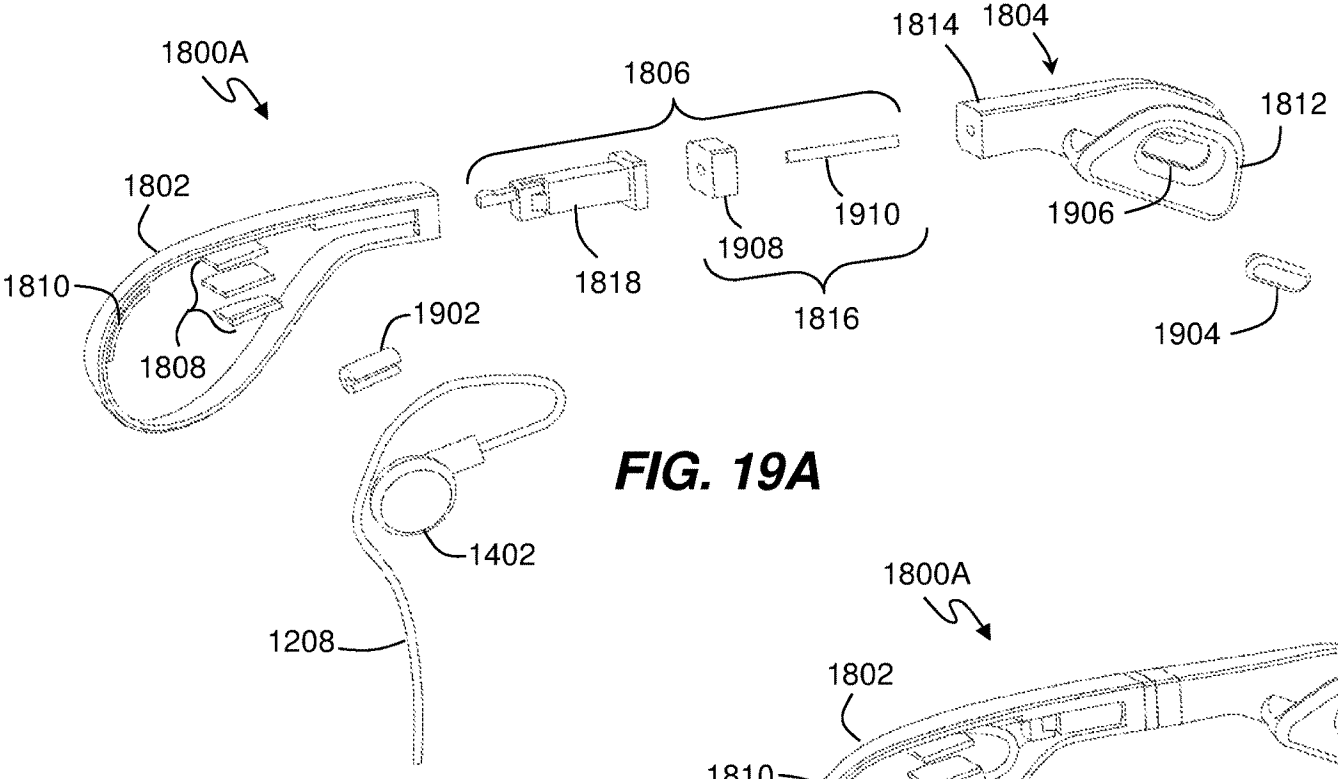
FIG. 19A is a diagram depicting an exploded view of one side of the alternative wearable personal sound speaker system kit of FIG. 18A according to embodiments of the present invention.

FIG. 19A is a diagram depicting an exploded view of the left side 1800A of the wearable personal sound speaker system kit 1800 of FIG. 18A. Some of the details of the example embodiment are more clearly represented in the exploded view. Specifically, the speaker mounting system 1808 includes at least three griping fingers that will accommodate at least two different size speakers 1402. In addition, a collar 1902 made of a flexible and conforming material on the inside (such as foam rubber) and a ridge shell on the outside can be provided to adapt various differently sized and shaped speakers 1402 to be securely mounted within the speaker housing 1802. In some embodiments, the collar 1902 can be made entirely of flexible, conforming material without an outer shell. The collar 1902 is snap fit onto the speaker 1402 (e.g., on a stem or neck of the speaker) and then the collar 1902 with the speaker 1402, is snap fit between a pair of the griping fingers of the speaker mounting system 1808. As described above with respect to other embodiments, the speaker 1402 can be secured within the speaker housing 1802 in many different ways and any practicable method can be used.

Figure 19B:
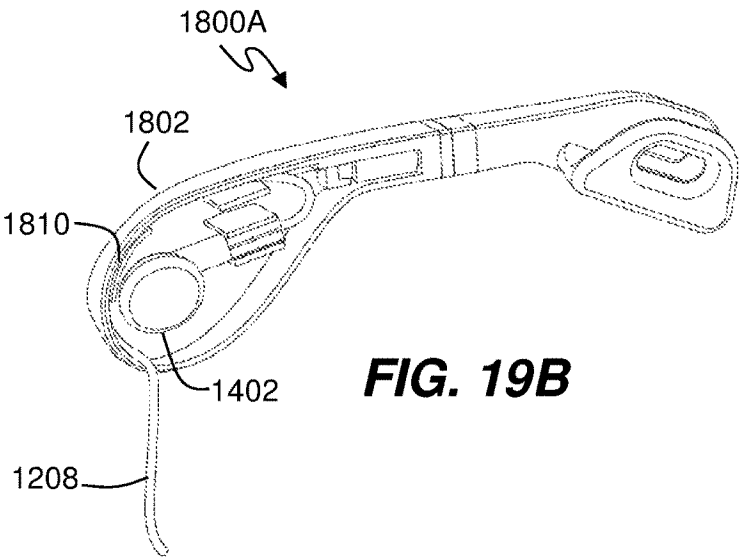
FIG. 19B is a diagram depicting an inner perspective view of one side of the alternative wearable personal sound speaker system kit of FIG. 18A with an earbud speaker installed according to embodiments of the present invention.

In addition, the integrally formed clip member 1812 that extends from the attachment frame 1814 of the attachment mechanism 1804 includes a press fit barb 1904 that can be inserted into an opening 1906 in the clip member 1812. Upon press fitting the barb 1904 into the opening 1906 in the clip member 1812, the worn item (e.g., a hat brim) is secured within the attachment mechanism 1804. Further, the illustrative example flexure bearing 1816 of the adjustable connector 1806 can include a foam rubber block 1908 and a bendable wire 1910 as with other embodiments described above. Assembly of the various components can be by any practicable means such as epoxy, welding, snap fit fittings, etc. FIG. 19B depicts the assembled left side 1800A of the wearable personal sound speaker system kit 1800 with an ear-bud speaker 1402 installed using the collar 1902 and including the speaker wire 1208 routed through the speaker wire channel 1810 of the speaker housing 1802.

Figure 20A:
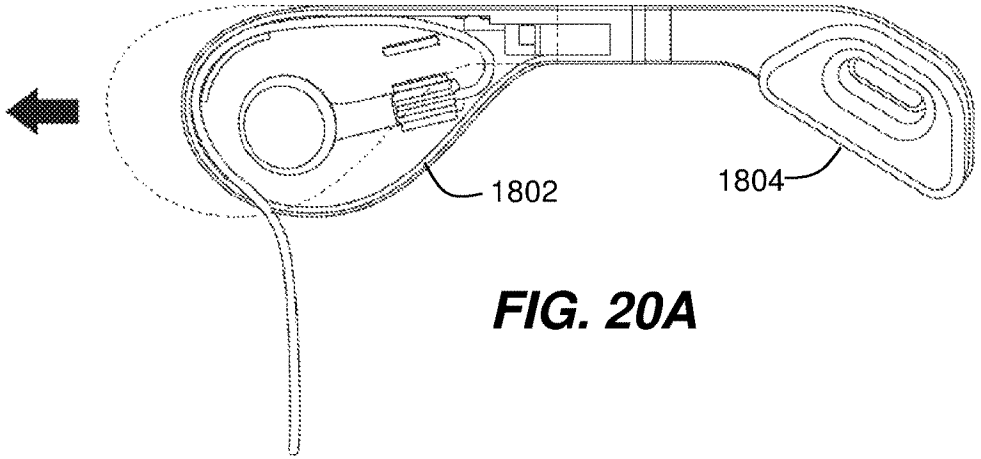
FIGS. 20A, 20B, and 20C are two side and one bottom view respectively of the one side of the alternative wearable personal sound speaker system kit of FIG. 18A illustrating adjustability of the system according to embodiments of the present invention.
Figure 20B:
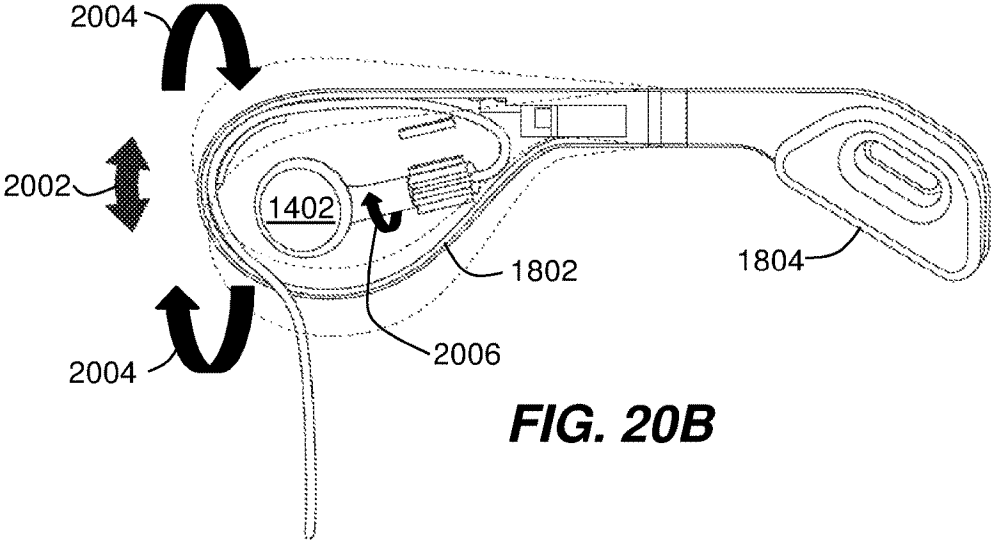
Figure 20C:
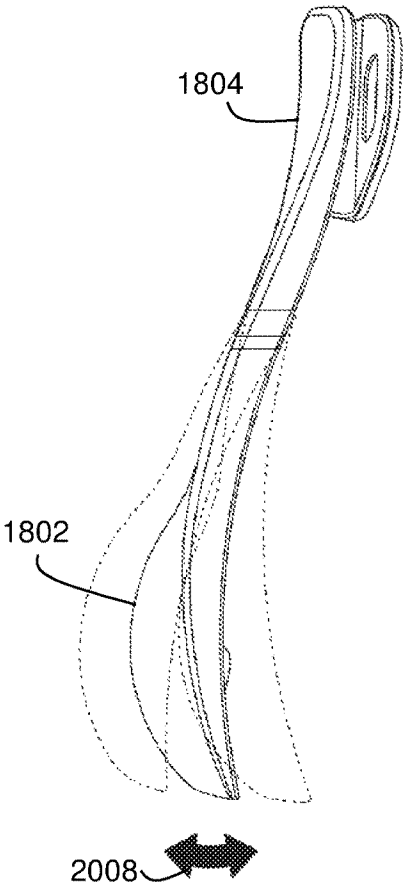

FIGS. 20A, 20B, and 20C depict two side views and one bottom view respectively of the left side 1800A of the wearable personal sound speaker system kit 1800 of FIG. 18A. These drawings illustrate the adjustability features of the kit. The solid arrow in FIG. 20A depicts the direction that the speaker housing 1802 can be extended away from the attachment mechanism 1804. The extended position is shown in phantom. The double ended arrow 2002 in FIG. 20B illustrates the direction of up and down position adjustments that can be made to the speaker housing 1802 relative to the attachment mechanism 1804. Higher (e.g., adjusted up) and lower (e.g., adjusted down) example positions of the speaker housing 1802 are indicated in phantom.

In addition, the arc arrows 2004 in FIG. 20B indicate the rotational adjustments that can be made to the orientation of the speaker housing 1802 relative to the attachment mechanism 1804. Note also that the speaker 1402 can be rotationally adjusted within the speaker housing 1802 as indicated by arc arrow 2006. These adjustability features insure that sound emanating from the speaker 1402 can be directed to the user's ear canal even when the speaker housing 1802 is positioned to not cover the user's ear. Thus, embodiments of the present invention allow a user to hear sound from the speakers with acceptable fidelity and volume and also allow the user to hear sounds from the surrounding environment.

The double ended arrow 2008 in FIG. 20C illustrates the direction of in and out position adjustments that can be made to the speaker housing 1802 relative to the attachment mechanism 1804. Wider (e.g., adjusted out) and closer (e.g., adjusted in) example positions of the speaker housing 1802 are indicated in phantom.

Figure 21A:
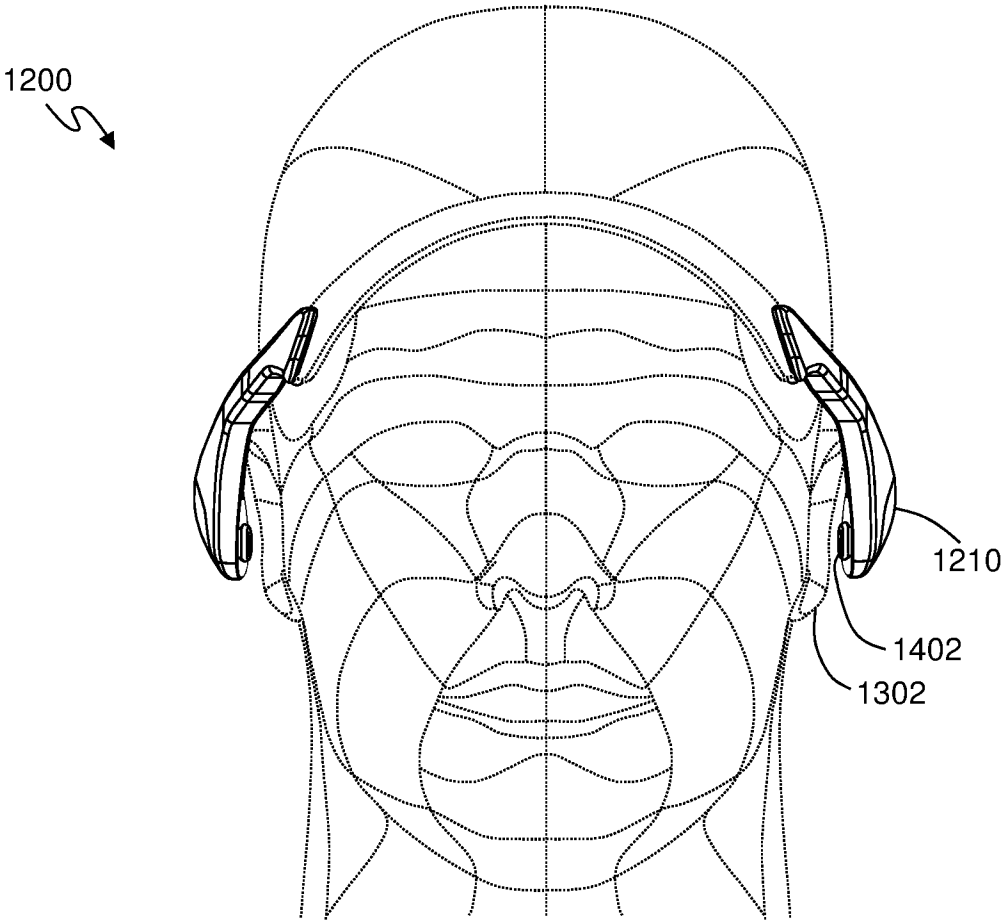
FIGS. 21A and 21B are front perspective views of the alternative wearable personal sound speaker system kit of FIG. 12 being worn in two different positions according to embodiments of the present invention.
Figure 21B:
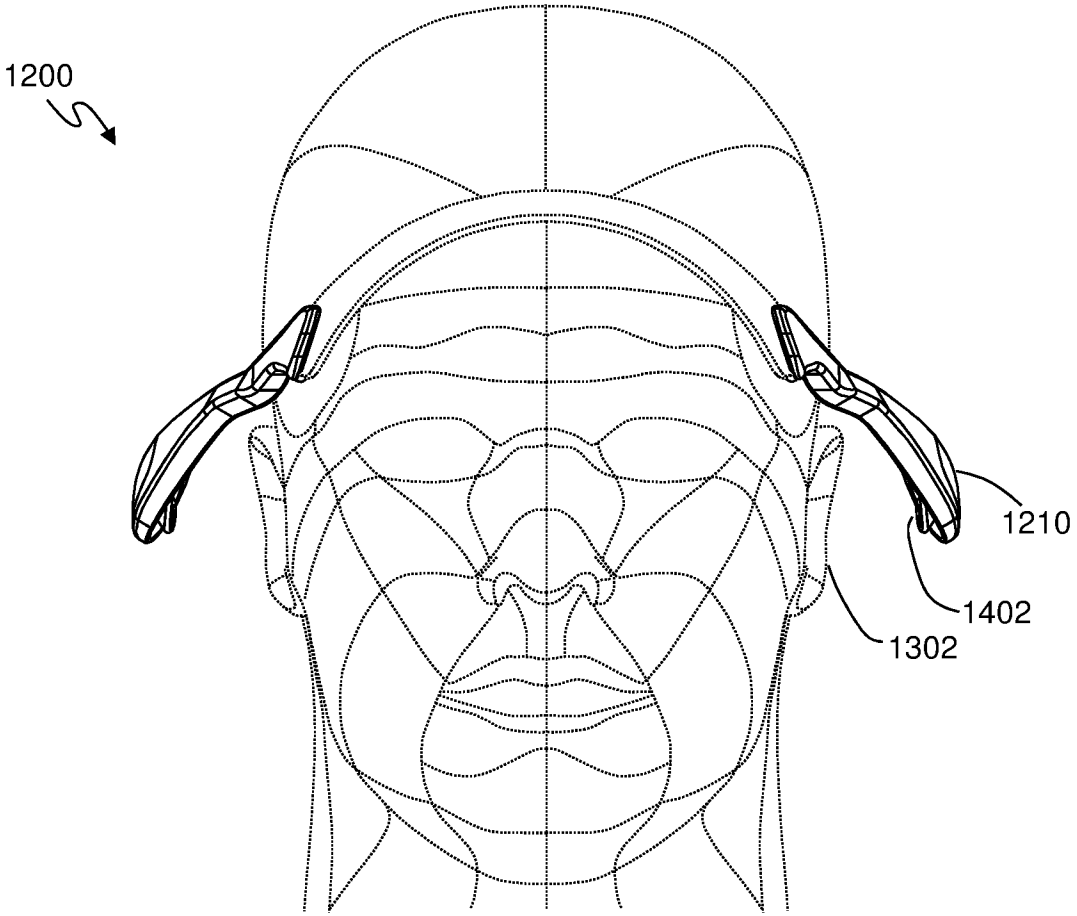

Turning now to FIGS. 21A and 21B, front perspective views of the wearable personal sound speaker system kit 1200 of FIG. 12 being worn in two different positions are illustrated. Note that the following description is equally applicable to the embodiment of the kit 1800 depicted in FIGS. 18A and 18B. In some instances, a user may prefer the improved fidelity and volume achievable by having the speakers 1402 relatively close to the user's ears 1302 while still enjoying the increased safety benefits of being able to hear sounds from the surrounding environment. In such instances, the embodiment depicted in FIG. 21A may be best suited to achieve the user's desires. The wearable personal sound speaker system kit 1200 as adjusted in FIG. 21A allows the user to clearly hear both sound from the speakers and the environment because neither the speaker 1402 nor the kit 1200 contacts the user's ears and no part of the system is in the user's ears.

In other instances however, the user may be required to not have anything blocking or covering their ears. For example, a running race may have rules that not only require the competitors to not use any device that is inserted in the ear or contacts the ear, the rules may specify that the competitor's ear must not be blocked or covered. In such circumstances, embodiments of the invention configured as depicted in FIG. 21B may be useful. In FIG. 21B, the speaker housings 1210 are adjusted (e.g., rotated) out and away from the user's ears at an approximately 30 degree angle so that the ears are not blocked or covered. In alternative embodiments, the speaker housings 1210 can be rotated out 45 degrees or up to 90 degrees or more. Note that the speakers 1402 can be angled to compensate for the position of the speaker housings 1210 and sound from the speakers can still be directed at the user's ear canal. More specifically, note that in both configurations depicted in FIGS. 21A and 21B, the face of the speakers 1402 are adjusted to direct sound at the user's ear canals even though the speaker housings 1210 are at different angles relative to the sides of the user's head.

Accordingly, while the present invention has been disclosed in connection with the preferred embodiments thereof, it should be understood that other embodiments may fall within the spirit and scope of the invention, as defined by the following claims.

What is claimed is:

1. A speaker system comprising:

an earbud including a speaker;

a housing having a cup shape and adapted to securely hold the earbud including the speaker;

a frame member;

an attachment member operable to allow attachment of the frame member to a head worn item; and an adjustable connector that couples the speaker housing to the frame member and allows aiming of the earbud including the speaker, wherein the system is adapted to support the earbud including the speaker proximate to a user's ear without the speaker system contacting the ear.

2. The system of claim 1 wherein the system includes an earbud including a speaker, a housing, a frame member, an attachment member, and an adjustable connector for each ear of a user.

3. The system of claim 1 wherein the adjustable connector is adjustable length-wise, pitch-wise, roll-wise, and yaw-wise.

4. The system of claim 3 wherein the adjustable connector includes at least one of a flexure bearing and a slide bearing.

5. The system of claim 1 wherein the housing includes an earbud mounting system adapted to allow the earbud including a speaker to be directed at the user's ear.

6. The system of claim 1 wherein the attachment member includes a clip member integrally formed with and extending from the frame and the head worn item includes at least one of a hat brim and an eyeglass frame.

7. The system of claim 1 wherein the system is further adapted to allow the user to hear both sound from the speaker and sound from a surrounding environment.

8. A wearable personal sound speaker system comprising:

a head wearable item;

a pair of earbuds each earbud including a speaker, and a kit adapted to support the speakers proximate to a user's ears without either covering the ears, the kit including for each ear of the user:

a housing having a cup shape and adapted to securely hold one of the earbuds;

an attachment mechanism adapted to secure the kit to the wearable item; and a connector adapted to couple the housing to the attachment mechanism.

9. The system of claim 8 wherein the connector is an adjustable connector.

10. The system of claim 9 wherein the adjustable connector includes at least one of a flexure bearing and a slide bearing.

11. The system of claim 8 wherein the housing includes an earbud mounting system adapted to allow the speaker of the held earbud to be directed at the user's ear.

12. The system of claim 8 wherein the attachment mechanism includes a clip member integrally formed with and extending from a frame and the wearable item includes at least one of a hat brim and an eyeglass frame.

13. The system of claim 8 wherein the kit is further adapted to allow the user to hear both sound from the speaker and sound from a surrounding environment.

14. A method of manufacturing a wearable personal sound speaker system kit, the method comprising:

providing a housing having a cup shape and adapted to securely hold an earbud including a speaker;

providing an attachment mechanism adapted to secure the kit to a worn item; and coupling the housing to the attachment mechanism using a connector, wherein the kit is adapted to support the earbud including the speaker proximate to a user's ear without the speaker system kit or earbud contacting the ear.

15. The method of claim 14 wherein manufacturing a wearable personal sound speaker system kit includes providing a housing and an attachment mechanism for each ear of the user.

16. The method of claim 14 wherein coupling the housing to the attachment mechanism using a connector includes coupling the housing to the attachment mechanism using an adjustable connector.

17. The method of claim 16 wherein using an adjustable connector includes using at least one of a flexure bearing and a slide bearing.

18. The method of claim 14 wherein providing a housing includes providing an earbud mounting system within the housing adapted to allow the speaker of the earbud to be directed at the user's ear.

19. The method of claim 14 wherein providing an attachment mechanism includes providing a clip member integrally formed with and extending from a frame of the attachment mechanism and wherein the worn item includes at least one of a hat brim and an eyeglass frame.

20. The method of claim 14 wherein manufacturing a wearable personal sound speaker system kit includes adapting the kit to allow the user to hear both sound from the speaker and sound from a surrounding environment.

* * * * *